US008998365B2

(12) United States Patent
Hasegawa

(10) Patent No.: US 8,998,365 B2
(45) Date of Patent: Apr. 7, 2015

(54) PRINTING APPARATUS AND PRINTING METHOD

(71) Applicant: Seiko Epson Corporation, Tokyo (JP)

(72) Inventor: Fumiaki Hasegawa, Azumino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/924,803

(22) Filed: Jun. 24, 2013

(65) Prior Publication Data

US 2013/0342595 A1 Dec. 26, 2013

(30) Foreign Application Priority Data

Jun. 25, 2012 (JP) ..... 2012-141703

(51) Int. Cl.

| | |
|---|---|
| ***B41J 29/38*** | (2006.01) |
| ***B41J 29/393*** | (2006.01) |
| ***B41J 2/13*** | (2006.01) |
| ***B41J 25/00*** | (2006.01) |

(52) U.S. Cl.

CPC *B41J 29/393* (2013.01); *B41J 2/13* (2013.01); *B41J 25/001* (2013.01)

(58) Field of Classification Search

CPC ..... B41J 2/04573; B41J 2/04556

See application file for complete search history.

(56) References Cited

U.S. PATENT DOCUMENTS

| | | | | |
|---|---|---|---|---|
| 6,154,240 | A * | 11/2000 | Hickman | 347/104 |
| 2007/0019017 | A1* | 1/2007 | Sussmeier | 347/14 |
| 2008/0158279 | A1* | 7/2008 | Barss | 347/14 |
| 2009/0251523 | A1* | 10/2009 | Noll | 347/106 |
| 2011/0279507 | A1* | 11/2011 | Castillo et al. | 347/16 |
| 2012/0274683 | A1* | 11/2012 | Yamasaki | 347/2 |
| 2013/0241982 | A1* | 9/2013 | Moore | 347/8 |

FOREIGN PATENT DOCUMENTS

| | | |
|---|---|---|
| JP | 09-029958 | 2/1997 |
| JP | 11-248440 | 9/1999 |
| JP | 2008-062391 A | 3/2008 |
| JP | 2010-100391 A | 5/2010 |

* cited by examiner

*Primary Examiner* — Shelby Fidler

(74) *Attorney, Agent, or Firm* — Harness, Dickey & Pierce, P.L.C.

(57) ABSTRACT

A printing method that forms images by arranging liquid material on a target print medium in such a manner that liquid droplets is discharged from discharge nozzles while relatively moving a discharge head, which is provided with the discharge nozzles that discharge the liquid material as the liquid droplets, and the target print medium, includes storing a shape pattern of the target print medium, detecting at least one piece of positional information for the target print medium, calculating a shape of the target print medium by comparing the detected positional information with the shape pattern, and calculating a distance between a nozzle surface and a target printing surface from the shape, and landing the liquid droplets onto the target printing surface by controlling landing positions of the liquid droplets depending on the distance between the nozzle surface and the target printing surface.

10 Claims, 16 Drawing Sheets

PRINTING APPARATUS AND PRINTING METHOD

BACKGROUND

1. Technical Field

The present disclosure relates to a printing apparatus and a printing method.

2. Related Art

In the related art, printing apparatuses that form (print) images on a target print medium using a liquid material by discharging liquid droplets of the liquid material from a discharge head and landing the liquid droplets onto arbitrary positions of the target print medium, have been known.

The discharge head discharges liquid droplets at loci (timings) that correspond to positions which are to be landed onto while being moved relatively with respect to the target print medium. The liquid droplets that are discharged from the discharge head fly to the target print medium and land onto landing positions on the target print medium. The flight time of the liquid droplets is a time that is obtained by dividing a distance (hereinafter referred to as "head gap") between discharge holes in a discharge direction of the liquid droplets from the discharge holes in the discharge head and landing positions on the target print medium by the flight speed of the liquid droplets. A distance in a relative movement direction of the discharge head and the target print medium between the discharge holes and the landing positions is the product of the relative movement speed and the flight time. Therefore, in order to maintain the positional accuracy of landing positions at a high level, it is necessary to maintain the relative movement speed and the flight time as constants.

However, there are cases in which the target print medium is deformed such as when warping occurs due to dead loads or heating in treatment processes prior to printing. In a case in which the target print medium has been deformed, since the head gap is no longer constant, the flight time of the liquid droplets is no longer constant. As a result of this, there are cases in which the accuracy of the landing positions is impaired.

An ink jet-type printing recording apparatus that is provided with a distance measurement section that measures the distance between a print head and a target print body and a control section that changes an ejection speed of ink droplets from the print head depending on the measured distance, is disclosed in JP-A-9-29958. According to JP-A-9-29958, using the ink jet-type printing recording apparatus, it is even possible to perform printing with high accuracy without printed characters becoming distorted in a case in which there is a change in the distance between the print head and the target print body.

However, since it is not possible to reduce a discharge period of the print head to be shorter than a measurement period of the distance measurement section in order to measure the distance (head gap) between the print head and the target print body for each landing point, there is a problem in that the printing speed is limited. It is also possible to reduce the number of positions at which the head gap is measured in order to maintain the printing speed, but in such a case, there are problems in that the land accuracy is impaired at positions where the head gap is not measured, and there is a high probability that printed image quality would be impaired as a result of shifting of the landing positions.

SUMMARY

The embodiments can be realized in the following forms or application examples.

According to this application example, there is provided a printing apparatus that includes a medium holding section that holds a target print medium, a discharge head, which is provided with a nozzle surface in which discharge nozzles that discharge liquid droplets are open, the nozzle surface is arranged so as to be able to face a holding surface of the medium holding section that holds the target print medium, a relative movement section that moves the discharge head and the medium holding section relatively, a pattern shape storage section that stores a shape pattern of the target print medium, a detection section that detects at least one piece of positional information for a target print medium held in the medium holding section, a head distance calculation section that calculates a shape of the target print medium by comparing at least one piece of positional information that is detected with the shape pattern, and calculates a distance between the nozzle surface and the target printing surface of the target print medium from the shape, and a control section that controls at least one of the discharge head and the relative movement section depending on the shape.

In this case, it is possible to detect at least one piece of positional information for the target print medium using the detection section and calculate a shape of the target print medium by comparing the positional information with a shape pattern stored in the pattern shape storage section using the head distance calculation section. Since the printing apparatus detects at least one piece of positional information for the target print medium and calculates shape of the target print medium by comparing the positional information with a shape pattern, it is possible to quickly determine the shape of the target print medium.

It is possible to calculate the distance between the nozzle surface and the target printing surface according to the shape of the target print medium a positional relationship between the medium holding section and the discharge head. It is possible to determine the distance quickly in comparison with a case in which the distance between the nozzle surface and the target printing surface is measured directly. In addition, since the calculation of the distance between the nozzle surface and the target printing surface can be executed in advance, before discharging from the discharge head, it is possible to substantially remove a situation in which printing speed is reduced as a result of the execution of the calculation of distance.

Since the control section controls at least one of the discharge head and the relative movement section depending on the distance between a nozzle surface and a target printing surface that correspond to a shape, it is possible to correct the landing positions of the liquid droplets to correspond to a change in the distance between the nozzle surface and the target printing surface that is generated as a result of the target print medium being deformed. As a result of this, it is possible to suppress shifting of the landing positions due to the change in distance. That is, it is possible to suppress a situation in which printing quality is impaired as a result of the target print medium being deformed.

In the printing apparatus according to the application example, it is preferable that, from the shape, the head distance calculation section further calculate a relationship between a distance in a relative movement direction by the relative movement section and a distance along the target printing surface, and the control section land liquid droplets onto landing positions for which a distance between landing positions on the target printing surface becomes a predetermined distance on the basis of the relationship between the distance in the relative movement direction and the distance along the target printing surface.

In this case, a relationship between a distance in a relative movement direction and a distance along the target printing surface is calculated by the head distance calculation section. As a result of this, a relationship between a discharging gap (distance) from the discharge head and a distance between the landing positions on the target printing surface that correspond to this discharge gap is calculated. In a case in which the target print medium is deformed, since the target printing surface is inclined with respect to the relative movement direction, the distance between landing positions on the target printing surface becomes longer with respect to the discharging gap (distance) in the relative movement direction. By landing liquid droplets onto landing positions for which a distance between landing positions on the target printing surface becomes a predetermined distance on the basis of the relationship of the distance between the landing positions on the target printing surface that correspond to the discharge gap calculated by the head distance calculation section, it is possible for the control section to suppress a situation in which the interval between landing positions on the target printing surface becomes longer as a result of the target print medium being deformed.

In the printing apparatus according to the application example, it is preferable that the detection section include a light emitting section that emits light that travels in at least a direction that is parallel to the holding surface, a light receiving section that detects the light emitted from the light emitting section, and a distance changing section that changes a distance in a direction that is perpendicular to the holding surface between a light path, which reaches from the light emitting section to the light receiving section, and the holding surface.

In this case, it is possible to detect the presence of an object in the light path that reaches from the light emitting section to the light receiving section by detecting the light emitted from the light emitting section with the light receiving section. It is possible to alter the distance between the light path and the holding surface using the distance changing section. As a result of this, it is possible to measure the height of a target print medium on the holding surface by detecting the distance between the light path and the holding surface when the target print medium on the holding surface blocks the light path.

In the printing apparatus according to the application example, it is preferable that the detection section be provided with a plurality of sets of light emitting sections and light receiving sections.

In this case, it is possible to measure the height at a plurality of positions using a plurality of sets of light emitting sections and light receiving sections. In addition, for example, it is possible to identify height measurement positions in a direction that is parallel to the holding surface at intersecting portions of the light path by arranging two sets of light emitting sections and light receiving sections in positions in which the light paths intersect one another.

In the printing apparatus according to the application example, it is preferable that the detection section further include a position changing section that changes relative positions of the light receiving section and light emitting section, and the holding surface in a direction that is parallel to the holding surface.

In this case, it is possible to change the relative positions of the light receiving section and light emitting section, and the holding surface in a direction that is parallel to the holding surface using the position changing section. As a result of this, it is possible to set the relative positions of the light path, which reaches from the light receiving section to the light emitting section, and the holding surface in a direction that is parallel to the holding surface, to arbitrary relative positions. That is, it is possible to set the height measurement positions to arbitrary relative positions. In addition, it is possible to measure the height at a plurality of positions with one set of light receiving sections and light emitting sections.

In the printing apparatus according to the application example, it is preferable that the control section include a discharge speed adjustment section that adjusts a flight speed of the liquid droplets that are discharged from the discharge nozzles, and control landing positions by adjusting the flight speed of the liquid droplets.

In this case, it is possible to adjust the flight speed of the liquid droplets using the discharge speed adjustment section. The flight time of discharged liquid droplets from the discharge nozzles to landing onto the target printing surface is a time that is obtained by dividing a distance between the nozzle surface and the target printing surface by the flight speed of the liquid droplets. The flight time is a time during which the discharged liquid droplets are moving in the relative movement direction. A distance in the relative movement direction of the liquid droplets from the positions of discharge to the landing positions thereof is decided by the flight time. That is, the landing positions are decided thereby. Even if the distance between the nozzle surface and the target printing surface fluctuates, by adjusting the flight speed, it is possible to suppress a situation in which the flight time fluctuates. That is, it is possible to maintain the landing positions at appropriate positions.

In the printing apparatus according to the application example, it is preferable that the control section include a discharge period adjustment section that adjusts the discharge period from the discharge nozzles, and control landing positions by adjusting the discharge period of the liquid droplets.

In this case, it is possible to adjust the discharge period from the discharge nozzles using the discharge period adjustment section. In a case in which the relative movement speed of the discharge head and the target print medium is constant, the distance in the relative movement direction between landing positions of the liquid droplets is proportional to the discharge period. It is possible to adjust the landing positions by adjusting the discharge period. That is, it is possible to adjust the landing positions so as to be maintained as appropriate positions.

In the printing apparatus according to the application example, it is preferable that the control section include a relative movement speed adjustment section that adjusts the relative movement speed by the relative movement section, and control landing positions by adjusting the relative movement speed.

In this case, it is possible to adjust the relative movement speed of the relative movement section using the relative movement speed adjustment section. In a case in which the discharge period from the discharge head is constant, the distance in the relative movement direction between landing positions of the liquid droplets is proportional to the relative movement speed. It is possible to adjust the landing positions by adjusting the relative movement speed. That is, it is possible to adjust the landing positions so as to be maintained as appropriate positions.

In the printing apparatus according to the application example, it is preferable that the control section include a head attachment/detachment section that causes the discharge head and the medium holding section to be detachably attached in a direction that is perpendicular to the nozzle surface, and control landing positions by adjusting the distance between the nozzle surface and the target printing surface.

In this case, it is possible to cause the discharge head and the medium holding section to be detachably attached in a direction that is perpendicular to the nozzle surface using the head attachment/detachment section. That is, it is possible to cause a target print medium held in the medium holding section and the nozzle surface to be detachably attached. As a result of this, by adjusting the distance between the target print medium and the nozzle surface, it is possible to control landing positions so as to suppress fluctuations in the landing positions that results from fluctuations in the distance between the target print medium and the nozzle surface.

According to this application example, there is provided a printing method that forms images by arranging liquid material on a target print medium in such a manner that liquid droplets are discharged from discharge nozzles while relatively moving a discharge head, which is provided with a nozzle surface in which the discharge nozzles that discharge the liquid material as the liquid droplets are open, and the target print medium, which includes storing a shape pattern of the target print medium, detecting at least one piece of positional information for the target print medium, calculating a shape of the target print medium by comparing at least one piece of positional information that is detected with the shape pattern, and calculating a distance between the nozzle surface and the target printing surface of the target print medium from the shape, and landing the liquid droplets onto the target printing surface by controlling landing positions of the liquid droplets depending on the shape.

In this case, it is possible to detect at least one piece of positional information for the target print medium in the detecting and calculate a shape of the target print medium by comparing the positional information with a shape pattern stored in the storing step in the calculating. Since the printing apparatus detects at least one piece of positional information for the target print medium and calculates shape of the target print medium by comparing the positional information with a shape pattern, it is possible to quickly determine the shape of the target print medium.

It is possible to calculate the distance between the nozzle surface and the target printing surface according to the shape of the target print medium and a positional relationship between the medium holding section and the discharge head. It is possible to determine the distance quickly in comparison with a case in which the distance between the nozzle surface and the target printing surface is measured directly. In addition, since the calculation of the distance between the nozzle surface and the target printing surface can be executed in advance, before discharging from the discharge head, it is possible to substantially remove a situation in which printing speed is reduced as a result of the execution of the calculation of distance.

Since the landing positions of the liquid droplets depending on the distance between a nozzle surface and a target printing surface that correspond to a shape is controlled in the liquid material arranging, it is possible to correct the landing positions of the liquid droplets to correspond to a change in the distance between the nozzle surface and the target printing surface that is generated as a result of the target print medium being deformed. As a result of this, it is possible to suppress shifting of the landing positions due to the change in distance. That is, it is possible to suppress a situation in which printing quality is impaired as a result of the target print medium being deformed.

In the printing method according to the application example, it is preferable that a relationship between a distance in a relative movement direction and a distance along the target printing surface be further calculated from the shape in the calculating, and the liquid droplets be landed onto landing positions for which a distance between landing positions on the target printing surface becomes a predetermined distance on the basis of the relationship between the distance in the relative movement direction and the distance along the target printing surface in the arranging.

In this case, a relationship between a distance in a relative movement direction and a distance along the target printing surface is calculated in the calculating. As a result of this, a relationship between a discharge gap (distance) from the discharge head and a distance between the landing positions on the target printing surface that correspond to this discharge gap, is calculated. In a case in which the target print medium is deformed, since the target printing surface is inclined with respect to the relative movement direction, the distance between landing positions on the target printing surface becomes longer with respect to the discharge gap (distance) in the relative movement direction. By landing liquid droplets upon landing positions for which a distance between landing positions on the target printing surface becomes a predetermined distance on the basis of the relationship of the distance between the landing positions on the target printing surface that correspond to the discharge gap calculated in the head distance calculation step, it is possible to suppress a situation in which the interval between landing positions on the target printing surface becomes longer as a result of the target print medium being deformed in the arranging.

BRIEF DESCRIPTION OF THE DRAWINGS

The embodiments will be described with reference to the accompanying drawings, wherein like numbers reference like elements.

DESCRIPTION OF EXEMPLARY EMBODIMENTS

Hereinafter, an embodiment of a printing apparatus and a printing method according to the present embodiments will be described with reference to the drawings. The present embodiment will be described using a liquid droplet discharge device in a printing system that prints marking images on a marking object as an example. The liquid droplet discharge device is provided with a liquid droplet discharge head, and is a device that prints images by discharging liquid droplets of a functional liquid from the liquid droplet discharge head. Additionally, for convenience of display, there are cases in which the drawings that are referred to in the following explanation are displayed with members or portions that have different vertical and horizontal scales to the actual members or portions.

Method for Discharging Liquid Droplets

Firstly, a method for discharging liquid droplets that is used in the printing of images will be described. The method for discharging liquid droplets has an advantage in that there is little waste in the use of a material and furthermore, that it is possible to accurately dispose desired amounts of the material at desired positions. An electric charge control type, a pressure vibrating type, an electromechanical conversion type, an electrothermal conversion type, an electrostatic absorption type and the like can be included as examples of the discharge technology of the method for discharging liquid droplets.

Among these types, an electromechanical conversion type uses the property of a piezo element (piezoelectric element) to become deformed upon receiving a pulsed electric signal, applies pressure to a space in which liquid material is accumulated through a member formed of a flexible material as a result of the piezo element becoming deformed, and discharges liquid material from discharge nozzles by extruding from the space. Since a piezo system does not heat the liquid material, it has an advantage in that there is little influence on the composition of the material and the like. In addition, this type has advantages such as the fact that it is possible to easily adjust the size of liquid droplets by adjusting a drive voltage and that it is possible to adjust the flight speed of the liquid droplets by adjusting the shape of a drive waveform. Due to the fact that the degree of freedom in selecting the liquid material is high since there is no influence on the composition of the material, and that the controllability of the liquid droplets is good since it is possible to easily adjust the size and flight speed of the liquid droplets, the present embodiment will be described using a liquid droplet discharge device provided with a liquid droplet discharge head that uses the abovementioned piezo type as an example.

Marking Object

Figure 1A:
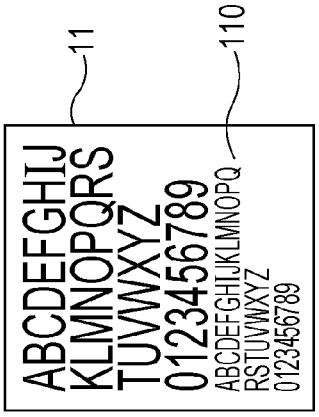
FIG. 1A is an explanatory drawing that shows a semiconductor package on which a marking image is printed.
Figure 1B:
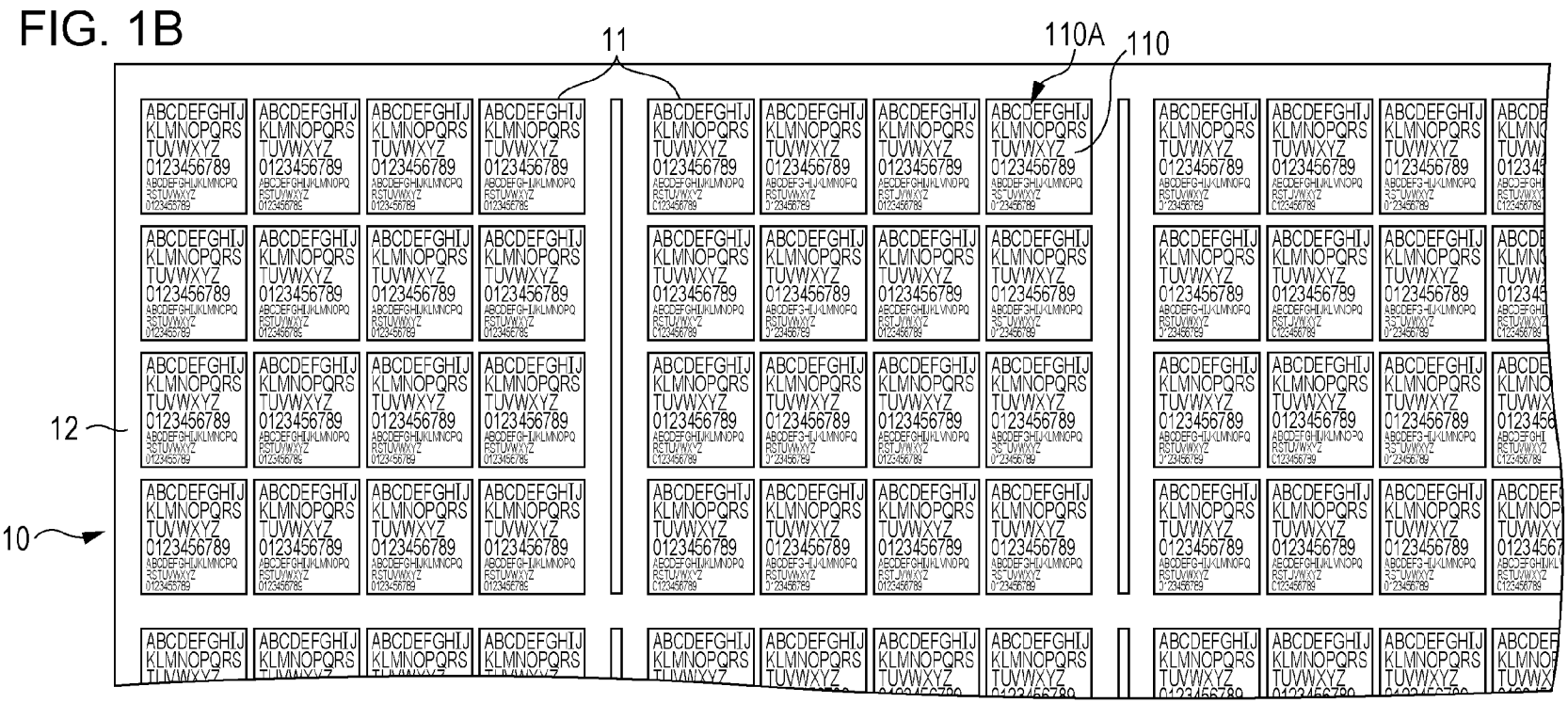
FIG. 1B is an explanatory drawing that shows a package printing body in which semiconductor packages are arrayed on a holding substrate.
Figure 1C:
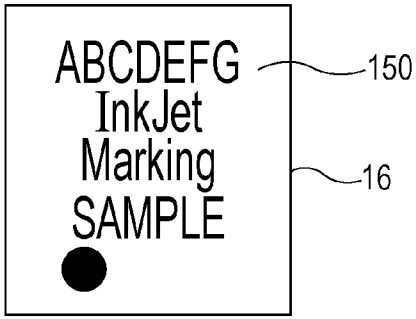
FIG. 1C is an explanatory drawing that shows a marking image that is printed on a semiconductor chip.
Figure 1D:
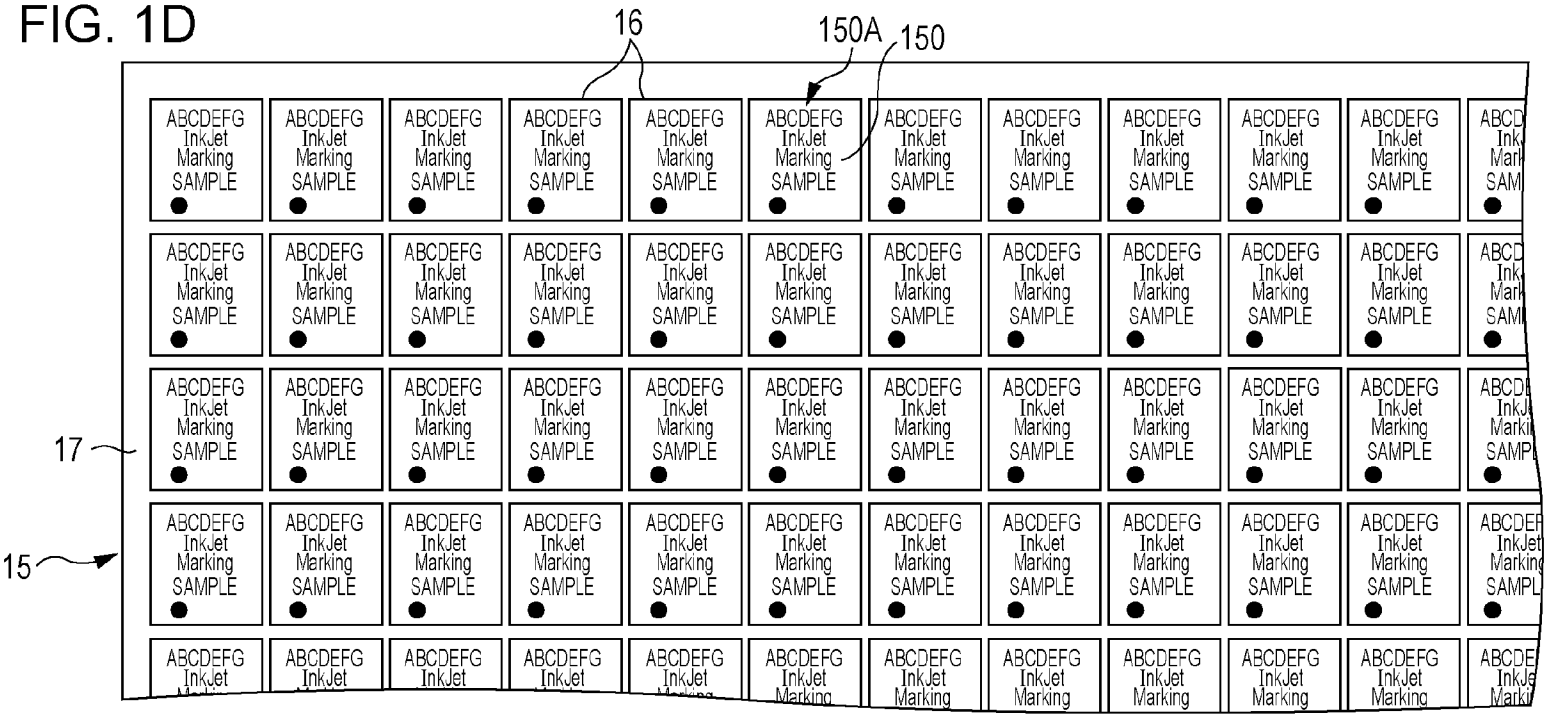
FIG. 1D is an explanatory drawing that shows a state in which semiconductor chips are arrayed on a holding substrate.

Next, a marking object will be described as a target print medium with reference to FIGS. 1A to 1D. FIGS. 1A to 1D are explanatory drawings that show a marking object and a marking image which is printed on the marking object. FIG. 1A is an explanatory drawing that shows a semiconductor package on which the marking image is printed. FIG. 1B is an explanatory drawing that shows a package printing body in which semiconductor packages are arrayed on a holding substrate. FIG. 1C is an explanatory drawing that shows a marking image that is printed on a semiconductor chip. FIG. 1D is an explanatory drawing that shows a state in which semiconductor chips are arrayed on a holding substrate.

A semiconductor package 11 shown in FIG. 1A is a mounted package using flip chip bonding. A package image 110 that is a marking image is printed on a surface that is on a side that is opposite a surface on which bumps are formed. The package image 110 is an image such as, for example, a logo, a product name, a product model number, a lot number.

As shown in FIG. 1B, semiconductor packages 11 are arrayed and temporarily fixed to a holding substrate 12, thereby configuring a package printing body 10. An image that is printed on the package printing body 10 is referred to as a package printing image 110A. The package printing body 10 is placed on a medium placement platform 30 (refer to FIGS. 3A and 3B) of a liquid droplet discharge device 1 (refer to FIGS. 3A and 3B), and a package image 110 is printed on a semiconductor package 11 by printing a package printing image 110A on a package printing body 10. The package printing body 10 corresponds to a target print medium.

In a semiconductor chip 16 that is shown in FIG. 1C, a chip image 150 that is a marking image is printed on a surface that is on a side that is opposite a surface on which a bonding pad is formed. The chip image 150 is an image such as, for example, a logo, a product name, a product model number, a lot number.

As shown in FIG. 1D, semiconductor chips 16 are arrayed and temporarily fixed to a holding substrate 17, thereby configuring a chip printing body 15. An image that is printed on the chip printing body 15 is referred to as a chip printing image 150A. The chip printing body 15 is placed on the medium placement platform 30 of the liquid droplet discharge device 1, and a chip image 150 is printed on a semiconductor chip 16 by printing a chip printing image 150A on a chip printing body 15. The chip printing body 15 corresponds to a target print medium.

Printing System

Figure 2:
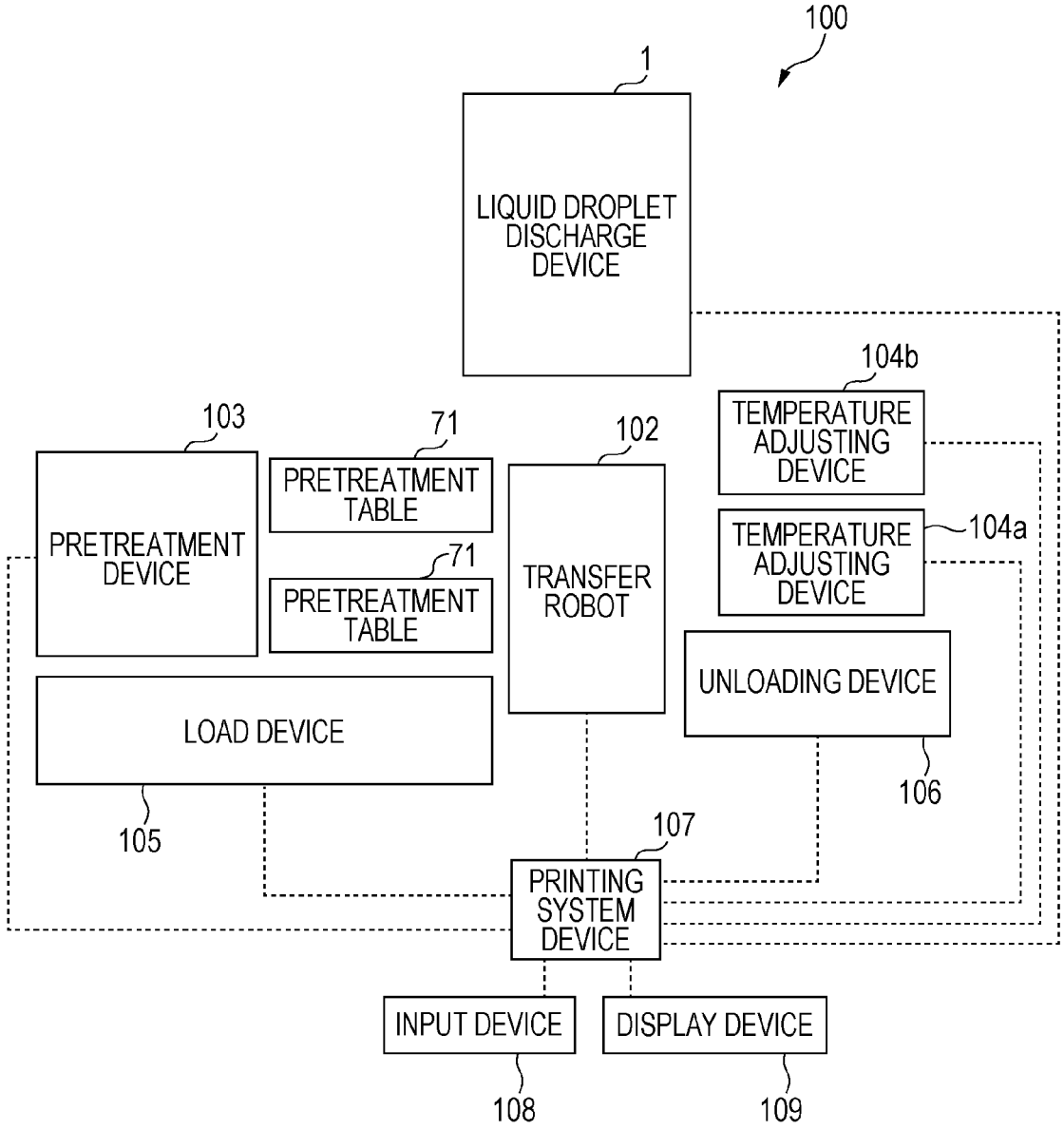
FIG. 2 is an explanatory drawing that shows a configuration of a printing system.

Next, a printing system that prints an image such as the chip printing image 150A on a printing object such as the above-mentioned chip printing body 15 will be described with reference to FIG. 2. FIG. 2 is an explanatory drawing that shows a configuration of the printing system.

As shown in FIG. 2, a printing system 100 is provided with a liquid droplet discharge device 1, a transport robot 102, a pretreatment device 103, a temperature adjustment device 104*a*, a temperature adjustment device 104*b*, a loading device 105, an unloading device 106, a printing system control device 107, an input/output device 108 and a display device 109.

The chip printing body 15 or the like is installed in a predetermined housing shelf (omitted from the drawings). The chip printing body 15 or the like is supplied to the printing system 100 by a housing shelf in which the chip printing body 15 or the like is installed being loaded into the loading device 105.

A chip printing body 15 or the like for which printing in the printing system 100 has been completed is moved onto a standby table (omitted from the drawings) of the unloading device 106, and is installed in a housing shelf that is loaded in the unloading device 106. A printed chip printing body 15 or the like is removed from the printing system 100 by ejecting the housing shelf from the unloading device 106.

The transport robot 102 places a chip printing body 15 or the like, that is ejected from a housing shelf loaded in the loading device 105 and placed on the standby table, to a predetermined position of the liquid droplet discharge device 1 or the pretreatment device 103. In addition, a chip printing body 15 on which a printing process or the like has been executed in the liquid droplet discharge device 1 or the pretreatment device 103 is removed from the liquid droplet discharge device 1 or the pretreatment device 103 and supplied to a device that will execute the next process.

The liquid droplet discharge device 1 prints an image such as the chip printing image 150A on a printing object such as the chip printing body 15. A printing object such as the chip printing body 15 supplied on the medium placement platform 30 is held by the transport robot 102, and the liquid droplet discharge device 1 prints an image such as the chip printing image 150A thereon. The liquid droplet discharge device 1 corresponds to a printing apparatus.

The pretreatment device 103 executes pretreatment in order to put a chip printing body 15 or the like into a favorable state for printing by the liquid droplet discharge device 1. In addition, there are cases in which the pretreatment device 103 is used as a curing device that irradiates curing light in order to cure a functional liquid that configures the chip printing image 150A or the like. A printing object such as the chip printing body 15 supplied on a pretreatment table 71 is held by the transport robot 102, and the pretreatment device 103 executes pretreatment thereon.

The temperature adjustment device 104*a* and the temperature adjustment device 104*b* adjust the temperature of a chip printing body 15 or the like to a suitable temperature for the execution of treatment by the pretreatment device 103 or printing by the liquid droplet discharge device 1. In addition, there are cases in which the temperature adjustment device 104*a* and the temperature adjustment device 104*b* are used in order to execute post-treatment such as heating in order to cure a functional liquid that configures the chip printing image 150A or the like.

The printing system control device 107 controls the respective devices mentioned above and the like according to image data, and causes an image such as the chip printing image 150A to be printed on a printing object such as the chip printing body 15.

The input/output device 108 is connected to the printing system control device 107. The input/output device 108 functions as input section for inputting a program, data or the like that will be stored in a storage device of the printing system control device 107. The printing system control device 107 controls the respective devices mentioned above and the like according to a program, data or the like that is stored in the storage device. In addition, the input/output device 108 also functions as output section of data that is acquired along with the activation of the respective devices and the like.

The display device 109 functions as a section that displays an activation state of respective devices.

Liquid Droplet Discharge Device

Figure 3A:
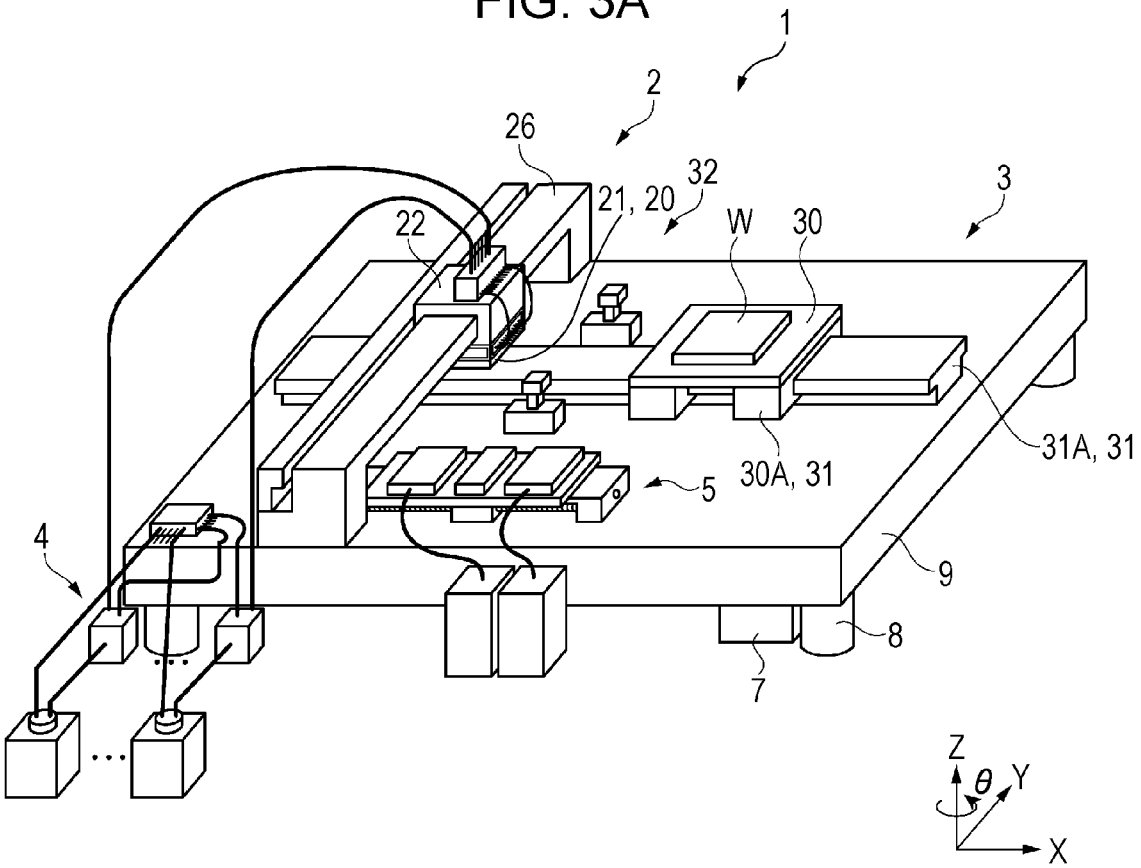
FIG. 3A is an external perspective drawing that shows a schematic configuration of a liquid droplet discharge device.
Figure 3B:
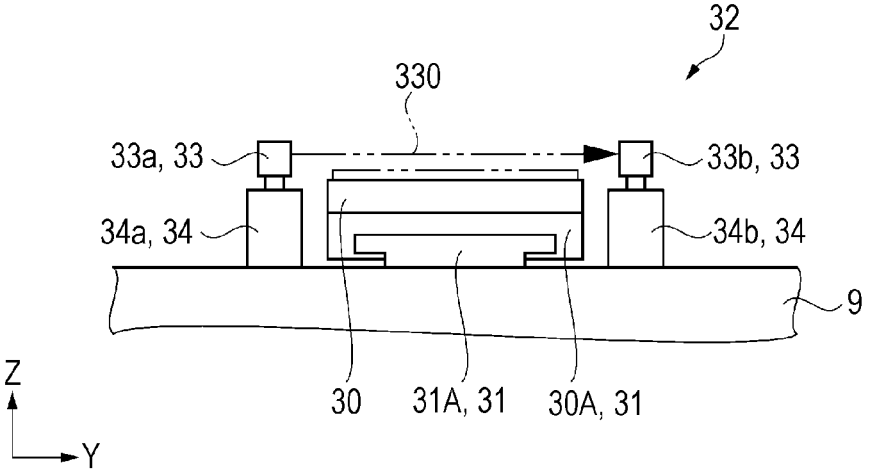
FIG. 3B is an explanatory drawing that shows a configuration of a medium mechanism section of the liquid droplet discharge device.

Next, an overall configuration of the liquid droplet discharge device 1 will be described with reference to FIGS. 3A and 3B. FIGS. 3A and 3B are drawings that show a schematic configuration of the liquid droplet discharge device. FIG. 3A is an external perspective drawing that shows the schematic configuration of the liquid droplet discharge device. FIG. 3B is an explanatory drawing that shows a configuration of a medium mechanism section of the liquid droplet discharge device.

As shown in FIGS. 3A and 3B, the liquid droplet discharge device 1 is provided with a head mechanism section 2, a medium mechanism section 3, a functional liquid supply section 4 and a maintenance device section 5. The head mechanism section 2 has a liquid droplet discharge head 20 that discharges a functional liquid as liquid droplets. The medium mechanism section 3 has the medium placement platform 30 that places work W that is a discharge target of the liquid droplets that are discharged from the liquid droplet discharge head 20. The functional liquid supply section 4 has an accumulation tank, a relay tank and a liquid supply tube, and the liquid supply tube is connected to the liquid droplet discharge head 20. A functional liquid is supplied to the liquid droplet discharge head 20 from the functional liquid supply section 4 through the liquid supply tube. The maintenance device section 5 is provided with respective devices that execute inspection and maintenance of the liquid droplet discharge head 20. In addition, the liquid droplet discharge device 1 is provided with a discharge device control section 7 that controls the respective mechanism sections as a whole.

Furthermore, the liquid droplet discharge device 1 is provided with a plurality of support legs 8 that are established above a floor, and a surface plate 9 that is established on the upper side of the support legs 8. The medium mechanism section 3 is arranged on the upper side of the surface plate 9 in a state of extending in a longitudinal direction (a direction of an X-axis) of the surface plate 9. The head mechanism section 2, which is supported by two support columns that stand on the surface plate 9, is arranged above the medium mechanism section 3 in a state of extending in a direction (a direction of a Y-axis) that is orthogonal to the medium mechanism section 3. In addition, the accumulation tank and the like of the functional liquid supply section 4, which have a liquid supply tube that communicates with the liquid droplet discharge head 20 of the head mechanism section 2, are disposed to the side of the surface plate 9. The maintenance device section 5 is arranged lined up next to the medium mechanism section 3 in the direction of the X-axis in the vicinity of one of the support columns of the head mechanism section 2. Furthermore, the discharge device control section 7 is accommodated on the underside of the surface plate 9.

The head mechanism section 2 is provided with a head unit 21 that has the liquid droplet discharge head 20, a head carriage that has the head unit 21, a movement frame 22 from which the head carriage is suspended and a Y-axis scanning mechanism 26 that moves the movement frame 22 in the direction of the Y-axis.

The liquid droplet discharge head 20 can be moved freely in the direction of the Y-axis by moving the movement frame 22 in the direction of the Y-axis using the Y-axis scanning mechanism 26. In addition, the movement frame 22 is held at a position to which it is moved.

The medium mechanism section 3 is provided with the medium placement platform 30, an X-axis scanning mechanism 31 and a height detection unit 32. The X-axis scanning mechanism 31 is provided with a sliding platform 30A and a sliding base 31A. The sliding base 31A is fixed to the upper side of the surface plate 9 and extends in the direction of the X-axis. The sliding platform 30A is supported so as to be capable of sliding freely on the sliding base 31A in the direction of the X-axis. The sliding platform 30A can be moved freely along the sliding base 31A in the direction of the X-axis by a drive motor (omitted from the drawings). In addition, the sliding platform 30A is held at a position to which it is moved. The medium placement platform 30 is supported by the sliding platform 30A through a rotating mechanism (omitted from the drawings). The medium placement platform 30 is capable of being freely rotated around a vertical axis (a Z-axis) by the rotating mechanism and is supported by the sliding platform 30A so as to be capable of being held at an arbitrary position.

In the medium mechanism section 3, work W that is placed on the medium placement platform 30 can be moved freely in the direction of the X-axis by moving the medium placement platform 30 in the direction of the X-axis using the X-axis scanning mechanism 31. In addition, the medium placement platform 30 is held at a position to which it is moved. The medium placement platform 30 corresponds to the medium holding section. The X-axis scanning mechanism 31 corresponds to the relative movement section.

The liquid droplet discharge head 20 moves to a discharge position in the direction of the Y-axis and stops, synchronizes with the movement in the direction of the X-axis of work W that is below the liquid droplet discharge head 20 and discharges a functional liquid as liquid droplets. It is possible to execute image rendering in a desired planar shape by relatively controlling the work W that moves in the direction of the X-axis and the liquid droplet discharge head 20 that moves in the direction of the Y-axis so as to land the liquid droplets onto arbitrary positions of the work W. The liquid droplet discharge head 20 corresponds to the discharge head.

The height detection unit 32, which the medium mechanism section 3 is provided with, is provided with a height detection sensor 33 and sensor elevating mechanisms 34. The height detection sensor 33 is provided with a light emitting section 33*a* and a light receiving section 33*b*. The light emitting section 33*a* and the light receiving section 33*b* are respectively fixed to the front ends of the sensor elevating mechanisms 34. The sensor elevating mechanism 34 which supports the light emitting section 33*a* is referred to as a sensor elevating mechanism 34*a* and the sensor elevating mechanism 34 which supports the light receiving section 33*b* is referred to as a sensor elevating mechanism 34*b*. The light emitting section 33*a* and the light receiving section 33*b* can be moved in a direction of the Z-axis by the sensor elevating mechanisms 34, and are capable of being held at an arbitrary height. The sensor elevating mechanism 34*a* and the sensor elevating mechanism 34*b* stand on the surface plate 9 at positions that pinch the sliding base 31A therebetween in the direction of the Y-axis.

The light emitting section 33*a* is held on the sensor elevating mechanism 34*a* in a posture in which a light axis of an emitted luminous flux 330 becomes the direction of the Y-axis. The light receiving section 33*b* is held on the sensor elevating mechanism 34*b* with a light detection surface thereof facing toward the light emitting section 33*a* side. The height relationship of the light emitting section 33*a* and the light receiving section 33*b* in the direction of the Z-axis is referred to as the light emitting section 33*a* and the light receiving section 33*b* being the same height in a state in which the light axis of the luminous flux 330 is consistent with the center of the light detection surface of the light receiving section 33*b*.

In a case in which the light emitting section 33*a* and the light receiving section 33*b* are the same height and the amount of emitted light of the light emitting section 33*a* is constant, because of the amount of light that is detected by the light receiving section 33*b*, it is possible to detect whether or not there is an object blocking the luminous flux 330. In addition, in a case in which the luminous flux 330 is divided into a region in which light is blocked and a region in which light reaches the light receiving section 33*b* with a boundary line as a border, because of the amount of light that is detected by the light receiving section 33*b*, it is possible to specify a position of the boundary line. For example, it is possible to detect a position of a surface of the medium placement platform 30 on which the work W or the like is placed. By determining the height of the light emitting section 33*a* and the light receiving section 33*b* in advance, it is possible to detect the height of a target printing surface of a chip printing body 15 or the like that is placed on the medium placement platform 30. It is possible to detect the schematic shape of the target printing surface of the chip printing body 15 or the like by moving the chip printing body 15 that is placed on the medium placement platform 30 and sequentially detecting the height of portion at which a position in the direction of the X-axis matches a position of the light axis of the luminous flux 330. The height detection unit 32 corresponds to the detection section.

The maintenance device section 5 is provided with various inspection devices, various maintenance devices and a maintenance device scanning mechanism. The inspection devices are devices such as a discharge inspection unit, which executes inspection of the discharging state of the liquid droplet discharge head 20, that executes inspection of the liquid droplet discharge head 20. The maintenance devices execute various maintenance of the liquid droplet discharge head 20. The maintenance device scanning mechanism is capable of moving each of the devices in the direction of the X-axis, and supporting so as to be capable of being held in an arbitrary position.

When the inspection or maintenance of the liquid droplet discharge head 20 is being executed, the head unit 21 (liquid droplet discharge head 20) is moved to a position that faces the maintenance device section 5 using the Y-axis scanning mechanism 26. In addition, an inspection device or a maintenance device that corresponds to the inspection or maintenance that is executed is moved to a position that faces the head unit 21 (liquid droplet discharge head 20) by the maintenance device scanning mechanism.

Liquid Droplet Discharge Head

Figure 4A:
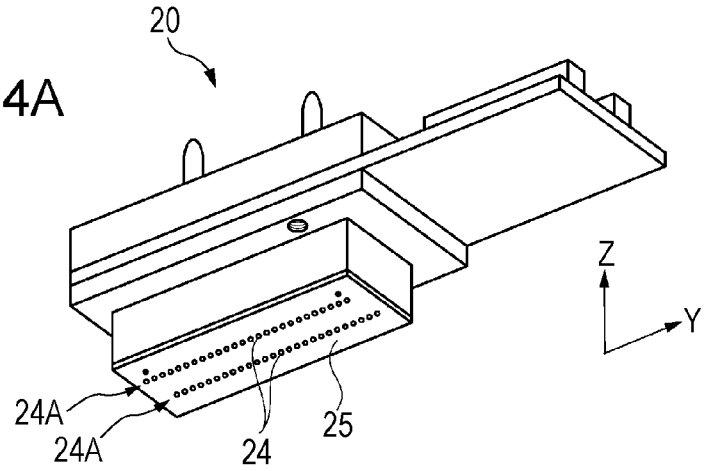
FIG. 4A is an external perspective drawing that shows a schematic configuration of a liquid droplet discharge head.
Figure 4B:
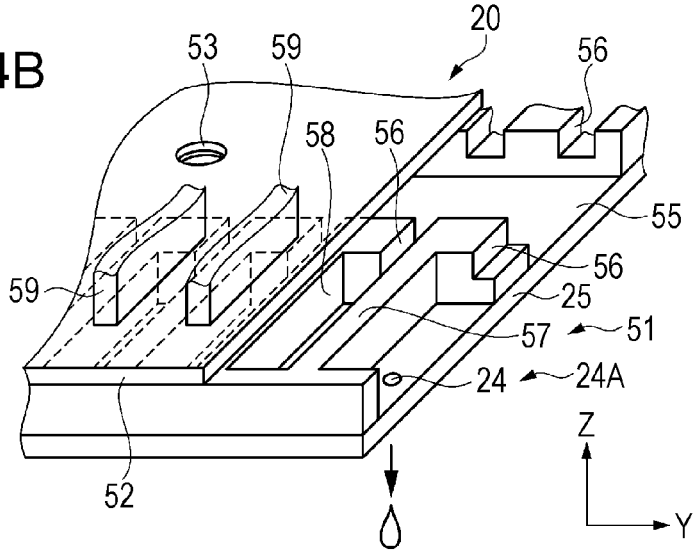
FIG. 4B is a perspective cross-sectional drawing that shows a configuration of the liquid droplet discharge head.
Figure 4C:
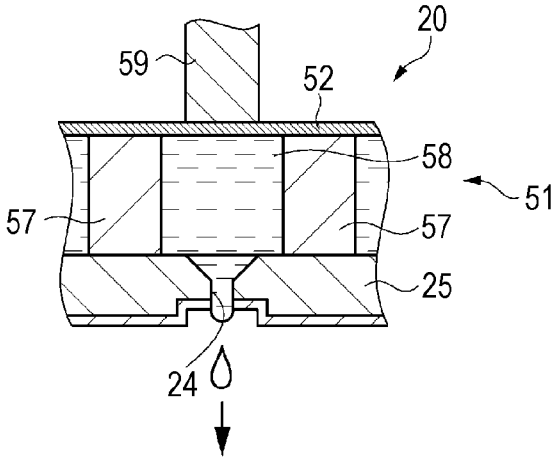
FIG. 4C is a cross-sectional drawing that shows a configuration of a portion of a discharge nozzle of the liquid droplet discharge head.

Next, the liquid droplet discharge head 20 will be described with reference to FIGS. 4A to 4C. FIGS. 4A to 4C are drawings that show a schematic configuration of the liquid droplet discharge head. FIG. 4A is an external perspective drawing that shows a schematic configuration of the liquid droplet discharge head. FIG. 4B is a perspective cross-sectional drawing that shows a configuration of the liquid droplet discharge head. FIG. 4C is a cross-sectional drawing that shows a configuration of a portion of a discharge nozzle of the liquid droplet discharge head. The direction of the Y-axis and the direction of the Z-axis shown in FIGS. 4A to 4C are consistent with the direction of the Y-axis and the direction of the Z-axis shown in FIGS. 3A and 3B in a state in which the liquid droplet discharge head 20 is installed in the liquid droplet discharge device 1.

As shown in FIG. 4A, the liquid droplet discharge head 20 is provided with a nozzle substrate 25. Two nozzle rows 24A in which multiple discharge nozzles 24 are lined up in substantially straight line form are formed in the nozzle substrate 25. Functional liquid is discharged from the discharge nozzles 24 as liquid droplets and landed onto a rendering object or the like that is in a position that faces the discharge nozzles 24, thereby disposing the functional liquid at the corresponding position. The nozzle rows 24A extend in the direction of the Y-axis shown in FIGS. 3A and 3B in a state in which the liquid droplet discharge head 20 is installed in the liquid droplet discharge device 1. The discharge nozzles 24 in the nozzle rows 24A lined up in a nozzle pitch with equally spaced intervals, and the position of the discharge nozzles 24 is shifted by half the nozzle pitch in the direction of the Y-axis between the two nozzle rows 24A. Therefore, as a liquid droplet discharge head 20, it is possible to dispose liquid droplets of a functional liquid with an interval of half the nozzle pitch in the direction of the Y-axis. A surface of an external side (a side that is opposite pressure chambers 58) of the nozzle substrate 25 corresponds to the nozzle surface.

As shown in FIGS. 4B and 4C, a pressure chamber plate 51 is laminated on the nozzle substrate 25 in the liquid droplet discharge head 20, and a vibration plate 52 is laminated on the pressure chamber plate 51.

A liquid accumulator 55 that is always filled with a functional liquid that is supplied to the liquid droplet discharge head 20 is formed on the pressure chamber plate 51. The liquid accumulator 55 is a space that is surrounded by the vibration plate 52, the nozzle substrate 25 and the wall of the pressure chamber plate 51. A functional liquid is supplied to the liquid droplet discharge head 20 from the functional liquid supply section 4, and supplied to the liquid accumulator 55 via a liquid supply hole 53 of the vibration plate 52. In addition, the pressure chambers 58 that are partitioned by a plurality of head partition walls are formed on the pressure chamber plate 51. The pressure chambers 58 are spaces that are surrounded by the vibration plate 52, the nozzle substrate 25, and two head partition walls 57.

The pressure chambers 58 are respectively provided to correspond to the discharge nozzles 24, and the number of pressure chambers 58 and the number of discharge nozzles 24 is the same. A functional liquid is supplied to the pressure chambers 58 from the liquid accumulator 55 via supply openings 56 that are positioned between the two head partition walls 57. A set of the head partition walls 57, the pressure chambers 58, the discharge nozzles 24 and the supply openings 56 is lined up along the liquid accumulator 55, and discharge nozzles 24 that are lined up in one row form a nozzle row 24A. In FIG. 4B, although not shown in the drawing, discharge nozzles 24 that are arranged lined up in one row form another nozzle row 24A in a position that is substantially symmetrical, in relation to the liquid accumulator 55, to the nozzle row 24A that includes the discharge nozzles 24 that are shown in the drawing. A set of head partition walls 57, pressure chambers 58 and supply openings 56 that corresponds to this nozzle row 24A is lined up in one row.

An end of a piezoelectric element 59 is respectively to a portion that configures the pressure chamber 58 of the vibration plate 52. The other end of the piezoelectric element 59 is fixed to a base platform (omitted from the drawings) that supports the entire liquid droplet discharge head 20 through a fixing plate 54 (refer to FIGS. 7A and 7B).

The piezoelectric element 59 has an active section in which an electrode layer and a piezoelectric material are laminated. In the piezoelectric element 59, the active section is compressed in a longitudinal direction (a thickness direction of the vibration plate 52 in FIGS. 4B and 4C) as a result of a drive voltage being applied to the electrode layer. The active section is returned to the original length thereof as a result of the drive voltage that is applied to the electrode layer being cancelled.

As a result of the active section of the piezoelectric element 59 being compressed by a drive voltage being applied to the electrode layer, the vibration plate 52 that is fixed to one end of the piezoelectric element 59 receives a force that pulls on a side that is opposite the pressure chambers 58. As a result of the vibration plate 52 being pulled on a side that is opposite the pressure chambers 58, the vibration plate 52 is warped on a side that is opposite the pressure chambers 58. As a result of this, since the cubic capacity of the pressure chambers 58 is increased, a functional liquid passes the supply openings 56 and is supplied to the pressure chambers 58 from the liquid accumulator 55. Next, as a result of the active section being returned to the original length thereof when the drive voltage that is applied to the electrode layer is cancelled, the piezoelectric element 59 applies a pressing force to the vibration plate 52. The vibration plate 52 returns to the side of the pressure chambers 58 as a result of a pressing force being applied thereto. As a result of this, the cubic capacity of the pressure chambers 58 rapidly returns to the original cubic capacity thereof. That is, since the increased cubic capacity is decreased, pressure is applied to a functional liquid that fills the inside of the pressure chambers 58, and the functional liquid is formed as liquid droplets and discharged from the discharge nozzles 24 that are formed to communicate with the pressure chambers 58.

Electrical Configuration of Liquid Droplet Discharge Device

Figure 5:
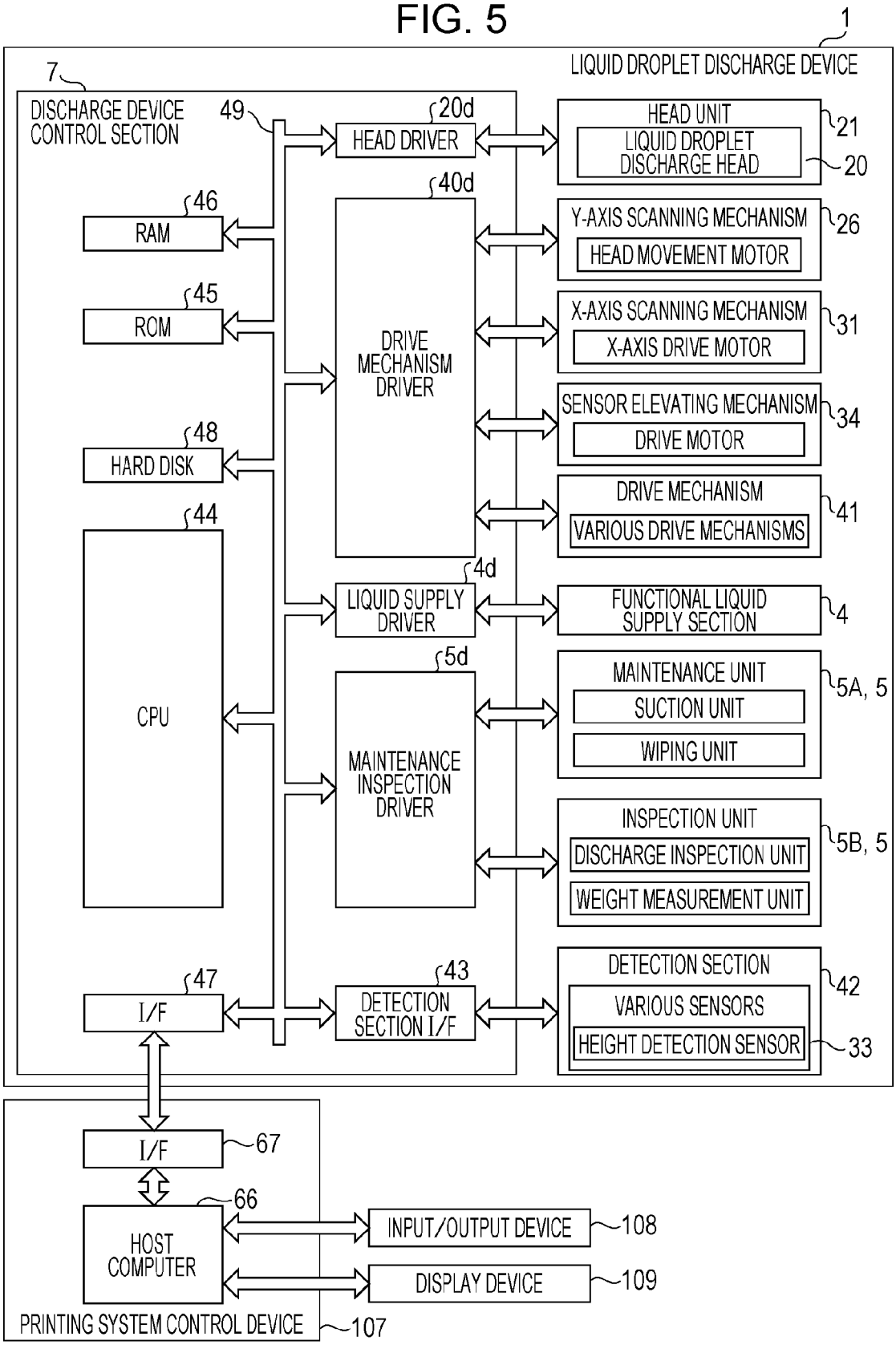
FIG. 5 is an electrical configuration block drawing that shows an electrical configuration of the liquid droplet discharge device.

Next, an electrical configuration for driving the liquid droplet discharge device 1 that has a configuration such as that described above, will be described with reference to FIG. 5. FIG. 5 is an electrical configuration block drawing that shows the electrical configuration of the liquid droplet discharge device.

The liquid droplet discharge device 1 is controlled by performing the input of data and the input of control instructions such as an activation start and a stop instruction through the abovementioned printing system control device 107. The printing system control device 107 has a host computer 66 that performs a calculation process, and is connected to the discharge device control section 7 through an interface (I/F) 67.

As shown in FIG. 2, the input/output device 108 and the display device 109 are connected to the printing system control device 107. The input/output device 108 functions as input section for inputting a program, data or the like in order to control the liquid droplet discharge device 1. In addition, the input/output device 108 functions as output section of data that is acquired along with the activation of the liquid droplet discharge device 1. The display device 109 functions as section that display an activation state or the like of the liquid droplet discharge device 1. The input/output device 108 is for example, a keyboard that is capable of inputting information, an external input/output device that performs the input and output of information through a recording medium, a recording section that saves information that is input through an external input/output device, a monitor device or the like.

The discharge device control section 7 of the liquid droplet discharge device 1 has an input/output interface (I/F) 47, a central processing unit (CPU) 44, a read only memory (ROM) 45, a random access memory (RAM) 46 and a hard disk 48. In addition, the discharge device control section 7 has a head driver 20*d*, a drive mechanism driver 40*d*, a liquid supply driver 4*d*, a maintenance inspection driver 5*d* and a detection section interface (I/F) 43. These components are electrically connected to one another through a data bus 49.

The input/output interface 47 performs the transfer of data with the printing system control device 107, the CPU 44 performs various calculation processes on the basis of instructions from the printing system control device 107, and outputs control signals that control the operations of each section of the liquid droplet discharge device 1. The RAM 46 temporarily saves control commands and printing data that are received from the printing system control device 107 according to instructions from the CPU 44. The ROM 45 stores a routine or the like for the performance of the various calculation processes that the CPU 44 carries out. The hard disk 48 saves control commands and printing data that are received from the printing system control device 107, and stores a routine or the like for the performance of the various calculation processes that the CPU 44 carries out.

The liquid droplet discharge head 20 that is included in the head unit 21 that configures the head mechanism section 2 is connected to the head driver 20*d*. The head driver 20*d* causes a functional liquid to be discharged as liquid droplets by driving the liquid droplet discharge head 20 according to a control signal from the CPU 44.

A head movement motor of the Y-axis scanning mechanism 26, an X-axis drive motor of the X-axis scanning mechanism 31, a drive source of the sensor elevating mechanisms 34 and a drive mechanism 41 that includes various drive mechanisms that have various drive sources are connected to the drive mechanism driver 40*d*. Various drive mechanism is a camera movement motor for moving an alignment camera, a θ drive motor of the medium placement platform 30 or the like. The drive mechanism driver 40*d* drives abovementioned motors and the like according to control signals from the CPU 44, and causes a functional liquid to be landed onto arbitrary positions of a printing object as liquid droplets in cooperation with the head driver 20*d* by moving the liquid droplet discharge head 20 and a printing object such as the chip printing body 15 relatively, causing arbitrary positions of the printing object and the liquid droplet discharge head 20 to face one another.

A suction unit and a wiping unit of a maintenance unit 5A that configures the maintenance device section 5 are connected to the maintenance inspection driver 5*d*. A discharge inspection unit, a weight measurement unit and the like that the inspection unit 5B that configures the maintenance device section 5 has are connected to the maintenance inspection driver 5*d*.

The maintenance inspection driver 5*d* executes maintenance work on the liquid droplet discharge head 20 by driving the suction unit or the wiping unit according to control signals from the CPU 44. In addition, inspection of the discharging state of the liquid droplet discharge head 20 such as inspection of whether or not discharge is taking place and inspection of the accuracy of landing positions is executed by driving the discharge inspection unit. In addition, the measurement of a discharge weight, which is the weight of the liquid droplets of a functional liquid that is discharged from the liquid droplet discharge head 20, is executed by driving the weight measurement unit.

A functional liquid supply section 4 is connected to the liquid supply driver 4*d*. The liquid supply driver 4*d* supplies a functional liquid to the liquid droplet discharge head 20 by driving the functional liquid supply section 4 according to control signals from the CPU 44. A detection section 42 that has various sensors such as the height detection sensor 33 is connected to the detection section interface (I/F) 43. Detection information that is detected by each of the sensors of the detection section 42 is transmitted to the CPU 44 through the detection section interface 43.

Discharge of Liquid Droplets

Figure 6:
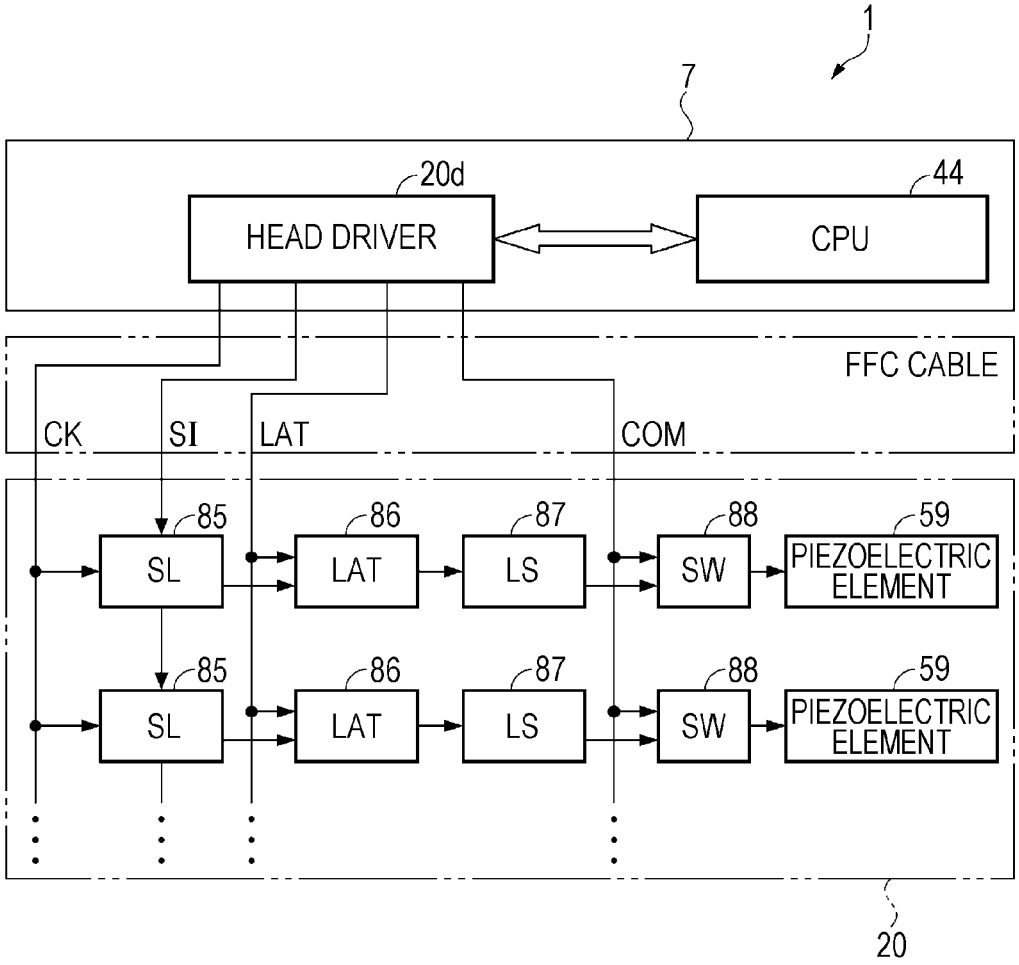
FIG. 6 is an explanatory drawing that shows an electrical configuration of the liquid droplet discharge head and a flow of signals.

Next, a method for controlling the discharge of liquid droplets from the liquid droplet discharge head 20 in the liquid droplet discharge device 1 will be described with reference to FIG. 6. FIG. 6 is an explanatory drawing that shows an electrical configuration of the liquid droplet discharge head and a flow of signals.

As described above, the liquid droplet discharge device 1 is provided with a discharge device control section 7 that controls the operation of each section of the liquid droplet discharge device 1. The discharge device control section 7 is provided with a CPU 44 that outputs control signals and a head driver 20*d* that performs electrical drive control of the liquid droplet discharge head 20.

As shown in FIG. 6, the head driver 20*d* is electrically connected to each liquid droplet discharge head 20 through an FFC cable. In addition, the liquid droplet discharge head 20 is provided with a shift register (SL) 85, a latch circuit (LAT) 86, a level shifter (LS) 87 and a switch (SW) 88 to correspond to the piezoelectric element 59 that is provided in each discharge nozzle 24 (refer to FIGS. 4A to 4C).

The discharge control in the liquid droplet discharge device 1 is performed in the following manner. Firstly, the CPU 44 transmits dot pattern data, which is an arrangement pattern of a functional liquid on a printing object such as the chip printing body 15 that has been transformed into data, to the head driver 20*d*. Further, the head driver 20*d* decodes the dot pattern data and creates nozzle data that is ON/OFF (discharge/non-discharge) information for each discharge nozzle 24. The nozzle data is transformed into a serial signal (SI), synchronized with a clock signal (CK) and transmitted to each shift register 85.

The nozzle data that is transmitted to the shift registers 85 is latched at a timing with which a latch signal (LAT) is input into the latch circuit 86, and furthermore, converted into a gate signal for the switch 88 by the level shifter 87. That is, in a case in which the nozzle data is "ON", the switch 88 is open and a drive signal (COM) is supplied to the piezoelectric element 59, and in a case in which the nozzle data is "OFF", the switch 88 is closed and a drive signal (COM) is not supplied to the piezoelectric element 59. Further, a functional liquid is formed as liquid droplets and discharged from discharge nozzles 24 that correspond to "ON", and the functional liquid is arranged on a printing object by landing liquid droplets of the discharged functional liquid on a printing object such as the chip printing body 15.

Drive Waveform

Figure 7A:
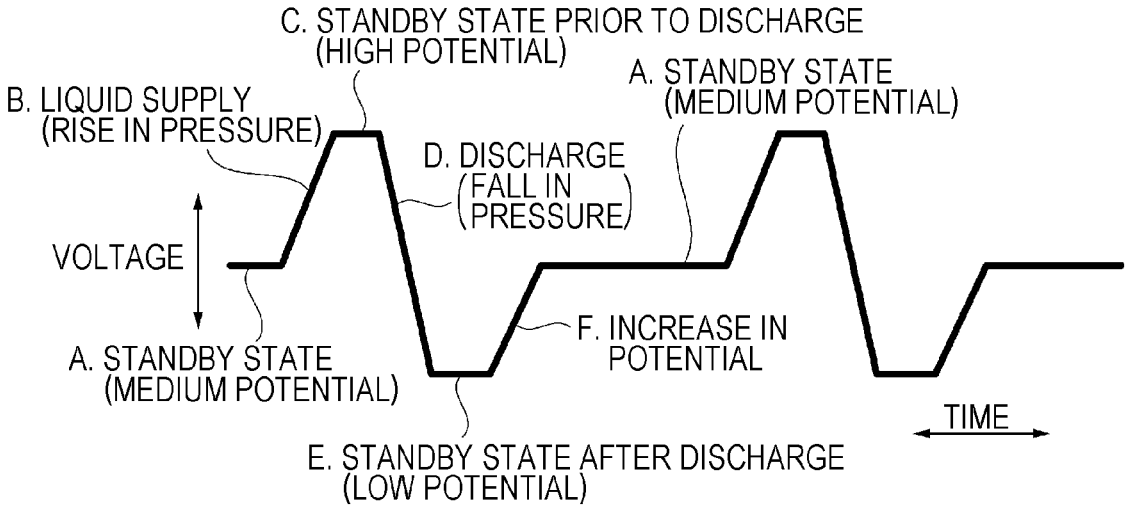
FIG. 7A is a drawing that shows a basic waveform of a drive waveform of a drive signal that is applied to a piezoelectric element.
Figure 7B:
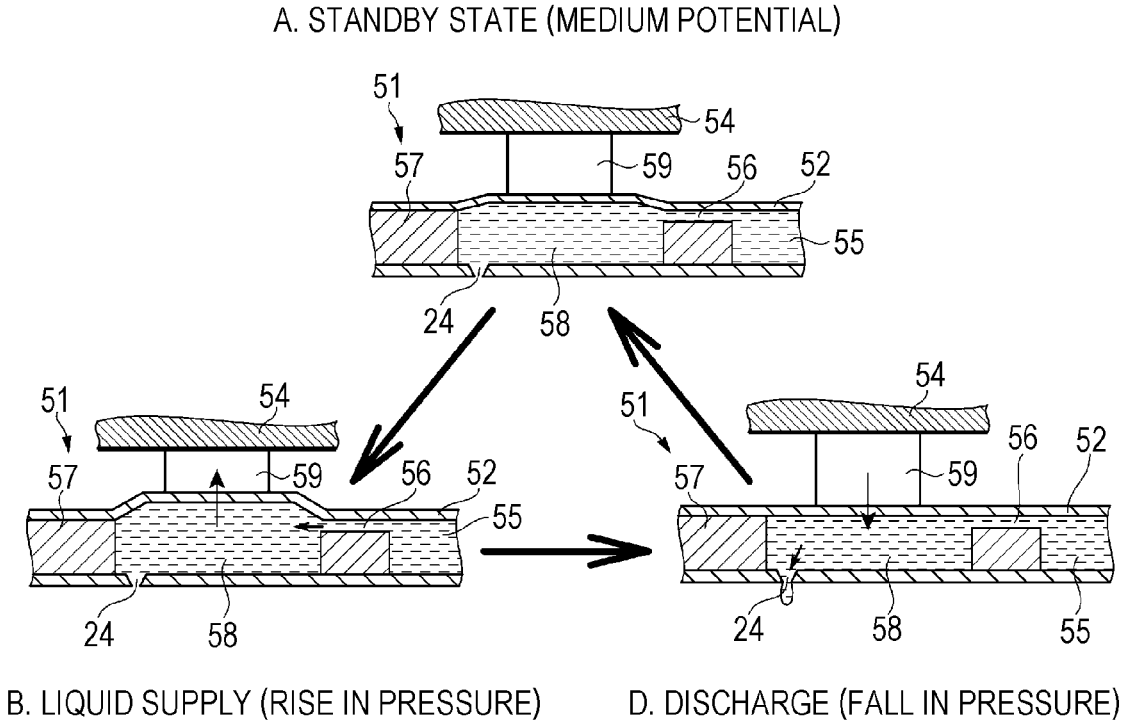
FIG. 7B is a schematic cross-sectional diagram that shows a discharge operation of the liquid droplet discharge head that results from the operation of a piezoelectric element that corresponds to the drive waveform.

Next, the drive waveform of a drive signal (COM) that is applied to the piezoelectric element 59 and the discharge operation that results from the operation of a piezoelectric element 59 to which a drive signal of the drive waveform has been applied, will be described with reference to FIGS. 7A and 7B. FIGS. 7A and 7B are drawings that show a basic waveform of a drive waveform and an operation of the piezoelectric element that corresponds to the drive waveform. FIG. 7A is a drawing that shows a basic waveform of a drive waveform of a drive signal that is applied to a piezoelectric element. FIG. 7B is a schematic cross-sectional drawing that shows a discharge operation of the liquid droplet discharge head that results from the operation of a piezoelectric element that corresponds to the drive waveform.

As shown in FIG. 7A, a constant voltage is applied to the piezoelectric element 59 in a standby state prior to a drive signal being applied (A in FIG. 7A). This voltage is referred to as a medium potential. When discharge is executed, the voltage that is applied to the piezoelectric element 59 is boosted to a medium potential before the start of discharge, and returned to a ground level after discharge has been completed.

The piezoelectric element 59 is slightly compressed in a standby state in which the piezoelectric element 59 is maintained at the medium potential. As described above, one end of the piezoelectric element 59 is fixed to the vibration plate 52 and the other end thereof is fixed to the fixing plate 54. As shown in FIG. 7B, as a result of the piezoelectric element 59 being slightly compressed, the vibration plate 52 is warped on a side that is opposite the pressure chambers 58 as a result of the vibration plate 52 being pulled on a side of the piezoelectric element 59 (A in FIG. 7B).

In a first step of a drive period, the voltage that is applied to the piezoelectric element 59 starts from the medium potential, and is boosted to a high potential (rise in pressure, B in FIG. 7A). The piezoelectric element 59 is compressed further as a result of the voltage that is applied to the piezoelectric element 59 being increased, and the vibration plate 52 receives a force that pulls on a side that is opposite the pressure chambers 58. As a result of the vibration plate 52 being pulled on a side that is opposite the pressure chambers 58, the vibration plate 52 that is formed of a flexible material is warped on a side that is opposite the pressure chambers 58. As a result of this, since the cubic capacity of the pressure chambers 58 is increased, a functional liquid passes the supply openings 56 and is supplied to the pressure chambers 58 from the liquid accumulator 55 (liquid supply, B in FIG. 7B). This step is referred to as an increased pressure liquid supply step. In the increased pressure liquid supply step, the piezoelectric element 59 is arranged slowly so that air from the discharge nozzles 24 does not enter the pressure chambers. The voltage of a high potential that is applied to the piezoelectric element 59 corresponds to a drive voltage that is applied in order to drive the liquid droplet discharge head 20.

After the increased pressure liquid supply step, the voltage that is applied to the piezoelectric element 59 is maintained in a state in which the high potential is retained. This state is referred to as a standby state prior to discharge (C in FIG. 7A). Since there are residual mechanical vibrations in the piezoelectric material that configures the piezoelectric element 59 after a voltage change has been completed, a step in which the liquid droplet discharge device 1 is in standby until these mechanical vibrations have settled is a standby state prior to discharge.

After the standby state prior to discharge has been retained for a period of time until the mechanical vibrations have settled, the voltage that is applied to the piezoelectric element 59 is immediately stepped down (D in FIG. 7A). As a result of the voltage that is applied to the piezoelectric element 59 being immediately stepped down, the arrangement of the piezoelectric element 59 immediately becomes zero and the pressure chambers 58 suddenly become narrow. As a result of this, a pressure in the pressure chambers 58 rises suddenly, and a functional liquid with which the insides of the pressure chambers 58 are filled is discharged from the discharge nozzles 24 (D in FIG. 7B). This step is referred to as a stepped down discharge step.

The amount by which the piezoelectric element 59 is compressed differs according to the voltage value of the high potential. As a result of the amount by which the piezoelectric element 59 is compressed differing, the amount by which the cubic capacity of the pressure chambers 58 increases also differs. Therefore, by changing the voltage value of the high potential, it is possible to adjust the amount of functional liquid with which the pressure chambers 58 are filled and that is discharged, that is the discharge amount from the discharge nozzles 24 of the liquid droplet discharge head 20.

In addition, the time at which the arrangement of the piezoelectric element 59 suddenly becomes zero differs according to the voltage value of the high potential. Therefore, by changing the voltage value of the high potential in piezoelectric element 59, it is possible to adjust the discharge speed of the liquid droplets that are discharged from the discharge nozzles 24. That is, it is possible to adjust the flight speed of the liquid droplets that are discharged. Furthermore, by adjusting the time of the standby state prior to discharge, the voltage value of the high potential, the time at which the voltage is stepped down and the like in an integrated manner, it is also possible to adjust the discharge speed of the liquid droplets while retaining a constant discharge amount.

After the stepped down discharge step, the voltage that is applied to the piezoelectric element 59 is maintained in a state in which a low potential is retained. This state is referred to as a standby state after discharge (E in FIG. 7A). A step in which a low potential state is retained until the mechanical vibrations of the piezoelectric element 59 have settled is the standby state after discharge.

After the standby state after discharge has been retained until the mechanical vibrations of the piezoelectric element 59 have settled, the voltage that is applied to the piezoelectric element 59 is boosted to a medium potential (F in FIG. 7A) and set as a standby state (medium potential) once again.

Landing Positions

Figure 8A:
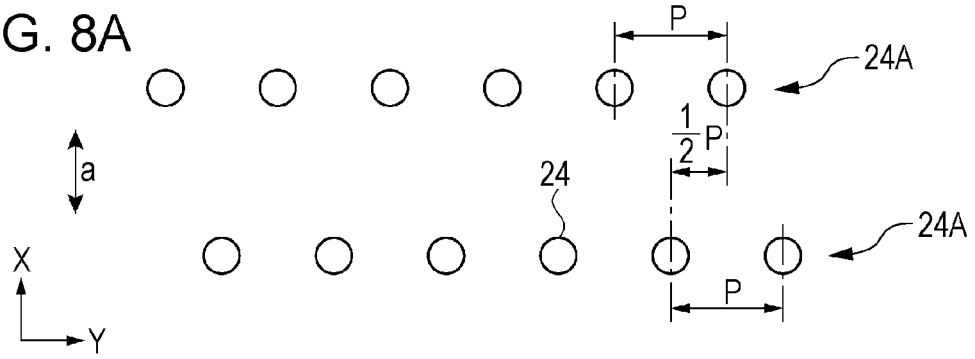
FIG. 8A is an explanatory drawing that shows arrangement positions of discharge nozzles.
Figure 8B:
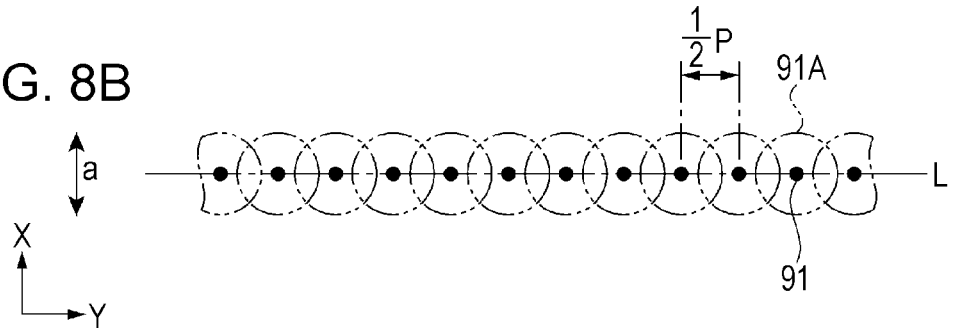
FIG. 8B is an explanatory drawing that shows a state of landing liquid droplets in a linear fashion in an extending direction of a nozzle row.
Figure 8C:
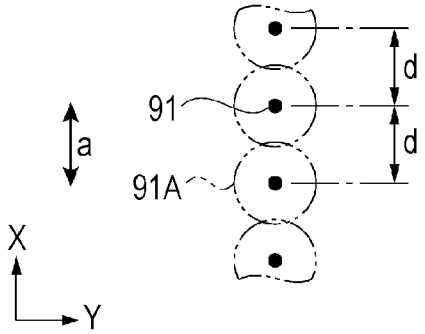
FIG. 8C is an explanatory drawing that shows a state of landing liquid droplets in a linear fashion in a main scanning direction.
Figure 8D:
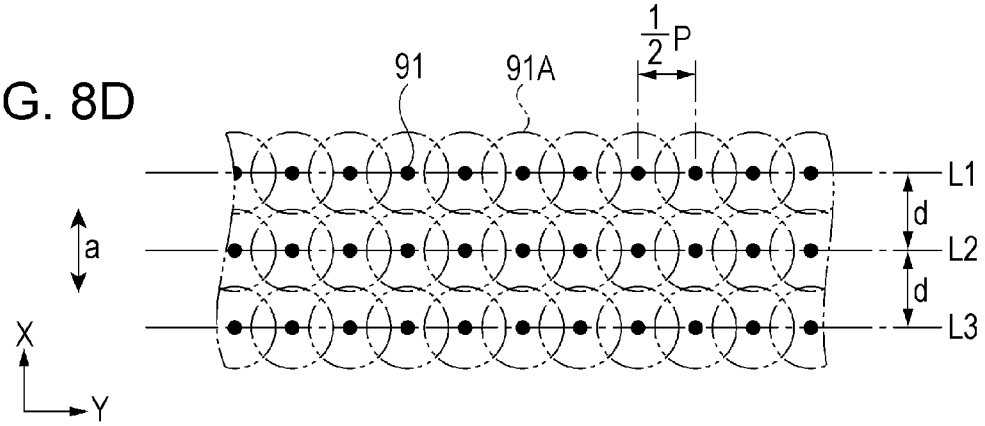
FIG. 8D is an explanatory drawing that shows a state of landing liquid droplets in a planar fashion.

Next, a relationship between the discharge nozzles 24 of the liquid droplet discharge head 20 and the respective landing positions of the liquid droplets that are discharged from the discharge nozzles 24 will be described with reference to FIGS. 8A to 8D. FIGS. 8A to 8D are explanatory drawings that show the relationship between discharge nozzles and respective landing positions of liquid droplets discharged from the discharge nozzles. FIG. 8A is an explanatory drawing that shows arrangement positions of discharge nozzles. FIG. 8B is an explanatory drawing that shows a state of landing liquid droplets in a linear fashion in an extending direction of a nozzle row. FIG. 8C is an explanatory drawing that shows a state of landing liquid droplets in a linear fashion in a main scanning direction. FIG. 8D is an explanatory drawing that shows a state of landing liquid droplets in a planar fashion. The direction of the X-axis and the direction of the Y-axis shown in FIGS. 8A, 8B, 8C and 8D are consistent with the direction of the X-axis and the direction of the Y-axis shown in FIGS. 3A and 3B in a state in which the head unit 21 is attached to the liquid droplet discharge device 1. The direction of the X-axis is a main scanning direction, and it is possible to land liquid droplets onto arbitrary positions in the direction of the X-axis by discharging liquid droplets of a functional liquid at arbitrary positions while moving the discharge nozzles 24 (the liquid droplet discharge head 20) relatively in a direction of an arrow a shown in FIGS. 8A, 8B, 8C and 8D.

As shown in FIG. 8A, the discharge nozzles 24 that configure the nozzle rows 24A are aligned in the direction of the Y-axis with a distance between the centers thereof that is equal to a nozzle pitch P. As described above, all of the discharge nozzles 24 that respectively configure the two nozzle rows 24A are each mutually shifted in the direction of the Y-axis to a position that is half the nozzle pitch P.

As shown in FIG. 8B, a state of one landed liquid droplet is shown using an land point 91 that shows an landing position and an land circle 91A that shows a wet spreading state of landed liquid droplets. By respectively landing liquid droplets from all of the discharge nozzles 24 of the two nozzle rows 24A at a timing that causes landing onto a hypothetical line L that is shown as a dashed-dotted line in FIG. 8B, a straight line in which the land circles 91A are continuous with a distance between the centers thereof that is equal to half the nozzle pitch P is formed.

As shown in FIG. 8C, by continuously discharging liquid droplets from a single discharge nozzle 24, a straight line in which the land circles 91A are continuous in the direction of the X-axis is formed. A minimum value of the distance between the centers of the landing points 91 in the direction of the X-axis is referred to as a minimum landing distance d. The minimum landing distance d is the product of the relative movement speed in the main scanning direction and a minimum discharge interval of the discharge nozzle 24.

The minimum landing distance d can be adjusted by adjusting the relative movement speed in the main scanning direction. In addition, the minimum landing distance d can be adjusted by adjusting the minimum discharge interval.

As shown in FIG. 8D, by respectively discharging liquid droplets at a timing that causes landing onto hypothetical lines L1, L2 and L3 that are shown as dashed-dotted lines, straight lines in which the land circles 91A are continuous with a distance between the centers thereof that is equal to half the nozzle pitch P are formed lined up in the direction of the X-axis on an land surface. In a case in which the distances between the hypothetical lines L1, L2 and L3 shown in FIG. 8D are the minimum landing distance d, the respective land points 91 are positions at which the liquid droplets of the functional liquid can be disposed by the liquid droplet discharge device 1.

At the time of rendering of images, the positions of the respective land points 91 shown in FIG. 8D determine the positions at which the liquid droplets are arranged according to image information. For example, images defined according to image information are rendered by forming an arrangement table that indicates corresponding arrangement positions and discharge nozzles 24 that discharge liquid droplets on the corresponding arrangement positions, and landing a functional liquid according to the arrangement table. Additionally, in the example that is shown in FIG. 8D, there are intervals between the land circles 91A, but it is possible to dispose the functional liquid without intervals by appropriately determining a discharge amount per liquid droplet that is discharged with respect to the nozzle pitch P and the minimum landing distance d. Naturally, it is also possible to dispose one droplet independently without overlapping other liquid droplets.

Control of Landing Positions

Figure 9A:
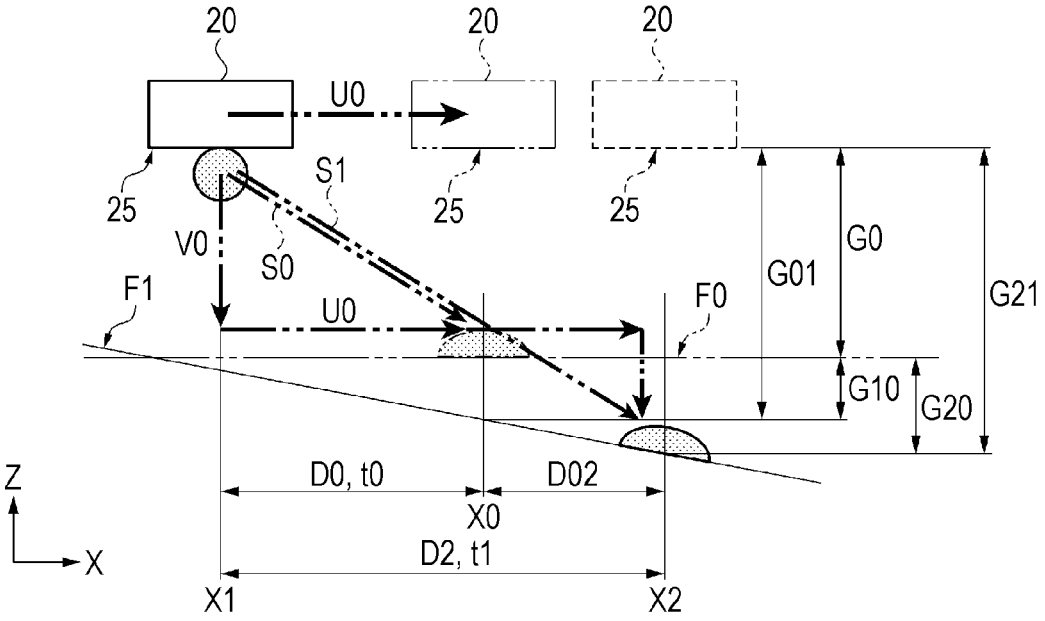
FIG. 9A is an explanatory drawing that shows landing positions in a case in which the target printing surface is in a normal state and a case in which the target printing surface is inclined.
Figure 9B:
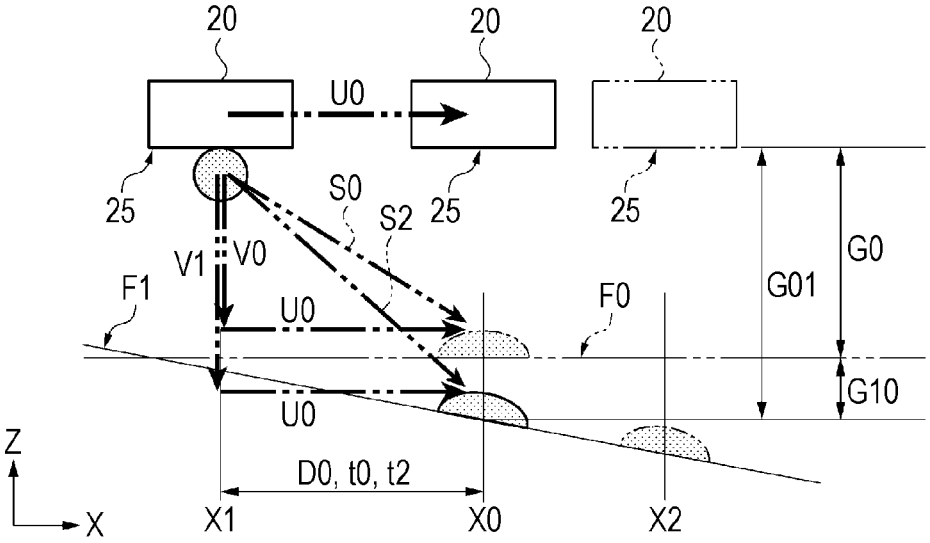
FIG. 9B is an explanatory drawing that shows a method of controlling the landing positions by adjusting a flight speed of the liquid droplets.
Figure 10C:
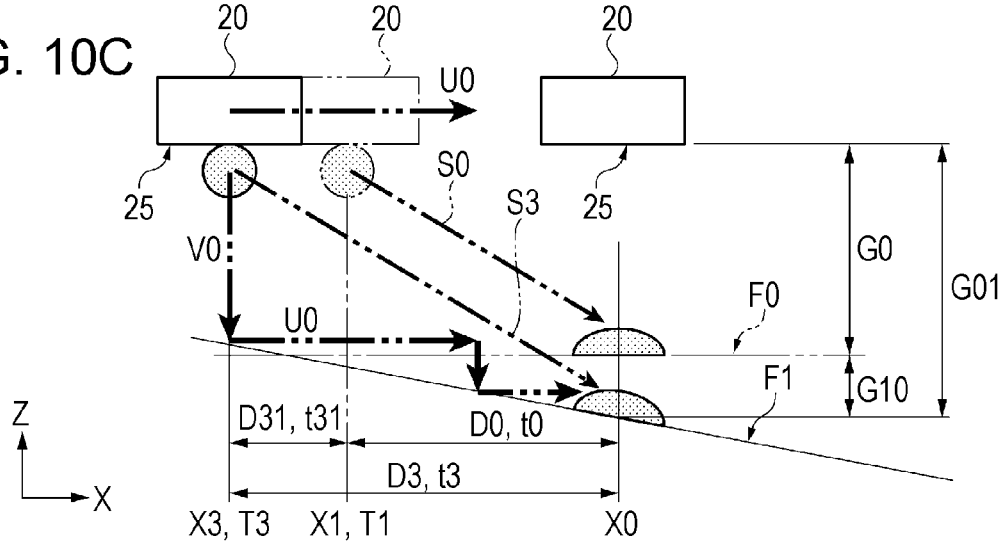
FIG. 10C is an explanatory drawing that shows a method of controlling the landing positions by adjusting a discharge period of the liquid droplets.
Figure 10D:
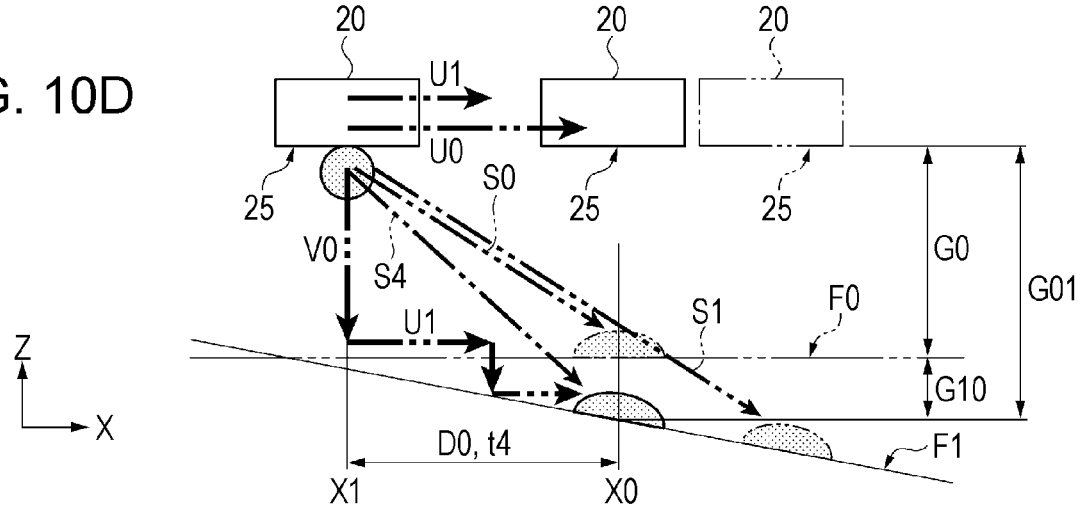
FIG. 10D is an explanatory drawing that shows a method of controlling the landing positions by adjusting a relative movement speed of the liquid droplet discharge head and a target print object.
Figure 10E:
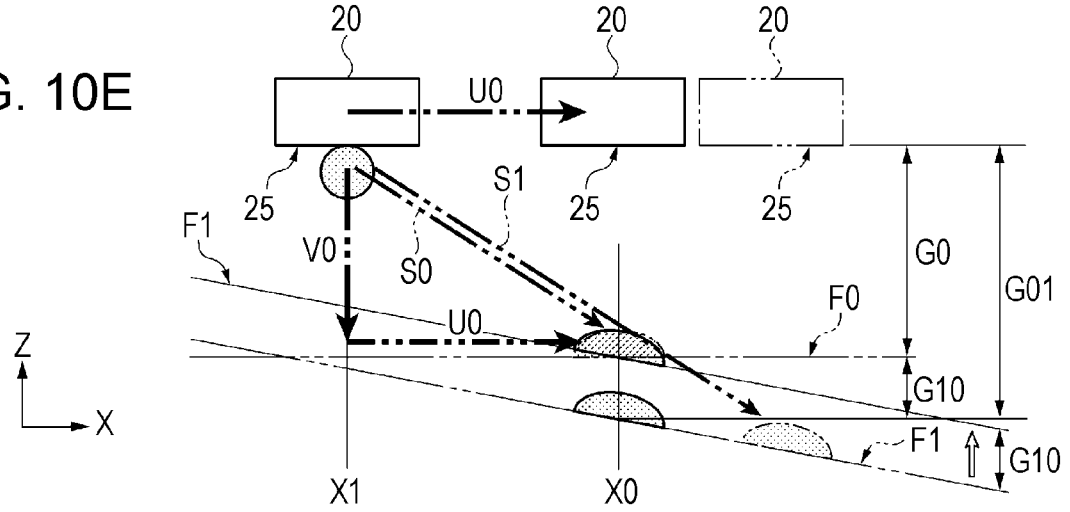
FIG. 10E is an explanatory drawing that shows a method of controlling the landing positions by adjusting a distance between the liquid droplet discharge head and a target print object.

Next, an example of controlling the landing positions by adjusting each component that has an influence on the landing positions will be described with reference to FIGS. 9A and 9B, and 10C to 10E. FIGS. 9A and 9B, and 10C to 10E are explanatory drawings that show a relationship between discharge positions from a liquid droplet discharge head and landing positions on a target printing surface along with each component that has an influence on the landing positions. FIG. 9A is an explanatory drawing that shows landing positions in a case in which the target printing surface is in a normal state and a case in which the target printing surface is inclined. FIG. 9B is an explanatory drawing that shows a method of controlling the landing positions by adjusting a flight speed of the liquid droplets. FIG. 10C is an explanatory drawing that shows a method of controlling the landing positions by adjusting a discharge period of the liquid droplets. FIG. 10D is an explanatory drawing that shows a method of controlling the landing positions by adjusting a relative movement speed of the liquid droplet discharge head and a target print object. FIG. 10E is an explanatory drawing that shows a method of controlling the landing positions by adjusting a distance between the liquid droplet discharge head and a target print object. The direction of the X-axis and the direction of the Z-axis shown in FIGS. 9A and 9B, and 10C to 10E are consistent with the direction of the X-axis and the direction of the Z-axis shown in FIGS. 3A and 3B.

As shown in FIG. 9A, a distance between a surface of the nozzle substrate 25 and a target printing surface F0 is referred to as a head gap G0. A target printing surface F1 is shown in an inclined state with respect to a relative movement direction of the liquid droplet discharge head 20 in which a target print object is deformed.

The relative movement speed of the liquid droplet discharge head 20 and the target printing surface F0 is referred to as a relative speed U0. The speed in the direction of the Z-axis of the liquid droplets discharged from the discharge nozzles 24 is referred to as a flight speed V0. In a case of landing onto the target printing surface F0, liquid droplets discharged at a discharge position X1 fly in a flight path S0 for a flight time t0 (seconds) and land onto an landing position X0 on the target printing surface F0. A distance in the direction of the X-axis between the discharge position X1 and the landing position X0 is referred to as a distance D0. X1 and X0 show the coordinate values in the direction of the X-axis of the discharge position X1 and the landing position X0. The relationship between the relative speed U0, the flight speed V0, the discharge position X1, the landing position X0 and the flight time t0 is expressed as follows.

$$D0=X0-X1$$

$$D0=t0\times U0$$

$$G0=t0\times V0$$

$$t0=D0/U0=G0/V0$$

In a case of landing onto the target printing surface F1, liquid droplets discharged at a discharge position X1 fly in a flight path S1 for a flight time t1 (seconds) and land onto an landing position X2 on the target printing surface F1. A distance in the direction of the X-axis between the discharge position X1 and the landing position X2 is referred to as a distance D2. X1 and X2 show the coordinate values in the direction of the X-axis of the discharge position X1 and the landing position X2, and D2=X2−X1. The distance (D2−D0) is referred to as a distance D02. A distance at the landing position X2 between a surface of the nozzle substrate 25 and the target printing surface F1 is referred to as a head gap G21. A distance at the landing position X0 between a surface of the nozzle substrate 25 and the target printing surface F1 is referred to as a head gap G01. A distance in the direction of the Z-axis at the landing position X2 between the target printing surface F0 and the target printing surface F1 is referred to as a head gap G20. A distance in the direction of the Z-axis at the landing position X0 between the target printing surface F0 and the target printing surface F1 is referred to as a head gap G10. The head gap G10 and the head gap G20 are expressed as follows.

$$G10=G01-G0$$

$$G20=G21-G0$$

In a case of landing onto the target printing surface F1, at a time point at which the liquid droplets have travelled through the air for the flight time t0 (seconds), the liquid droplets have travelled through the air in the direction of the Z-axis for the distance of the head gap G0, the distance between the target printing surface F1 is the gap G10, and the liquid droplets do not reach the land. The liquid droplets land at a position at which the liquid droplets have further travelled through the air in the direction of the Z-axis for the distance of the head gap G20, that is, a time point at which the liquid droplets have travelled through the air for the flight time t1 (seconds). During the time which the liquid droplets are travelling through the air in the direction of the Z-axis for the distance of the head gap G20, the liquid droplets fly in the direction of the X-axis for a distance of D02=D2−D0. As a result of the target printing surface F0 being inclined in the manner of the target printing surface F1, an amount of shifting of landing positions of the distance D02 is generated.

As shown in FIG. 9B, it is possible to land onto the target printing surface F1 at an landing position X0 by setting a speed of the liquid droplets in the direction of the Z-axis as a flight speed V1. The flight speed V1 is determined in the following manner.

$$V1=V0\times(G01/G0)$$

A flight time t2 that is taken to fly for a distance of G01 at the flight speed V1 is determined in the following manner.

$$t2=G01/V1=G01/(V0\times(G01/G0))=G0/V0=t0$$

Therefore, t2=t0, and an amount of movement in the relative movement direction (the direction of the X-axis) for this period of time is t0×U0=D0. In this manner, the liquid droplets that are discharged at the discharge position X1 with a flight speed V1 fly in a flight path S2 for a flight time t0 (seconds) and land onto an landing position X0 on the target printing surface F1.

In this manner, it is possible to control the landing positions and control the shifting of the landing positions that is caused by changes in the head gap by adjusting the flight speed in the direction of the Z-axis of the liquid droplets.

As shown in FIG. 10C, it is possible to land onto the target printing surface F1 at the landing position X0 by setting the position from which the liquid droplets are discharged as a discharge position X3. In order to set the discharge position X3, a time point at which the liquid droplets are discharged is made to be sooner by reducing a discharge period. Since it is possible to change the time point at which the liquid droplets are discharged by changing the discharge period, it is possible to change the position from which the liquid droplets are discharged.

A time point at which the discharge nozzles 24 are positioned at the discharge position X1 is referred to as a time point T1, and a time point at which the discharge nozzles 24 are positioned at the discharge position X3 is referred to as a time point T3. A time that is taken to move relatively from the discharge position X3 to the discharge position X1 is referred to as a movement time t31.

$$t31=T1-T3.$$

A relative movement distance from the discharge position X3 to the discharge position X1 is referred to as a movement distance D31.

$$D31=t31\times U0.$$

A relative movement distance from the discharge position X3 to the landing position X0 is referred to as a movement distance D3.

$$D3=D31+D0.$$

The movement time t31 is a time taken to fly for a distance of G10 at a flight speed V0.

t31 is determined as t31=G10/V0.

A time taken to fly for a distance of G01 at a flight speed V0 is referred to as a flight time t3.

$$t3=t31+t0$$

A relative movement distance during the flight time t3 is U0×t3.

$$U0\times t3=U0\times(t31+t0)=U0\times t31+U0\times t0=D31+D0=D3$$

A movement distance in the direction of the Z-axis during the flight time t3 is V0×t3.

$$V0\times t3=V0\times(t31+t0)=V0\times t31+V0\times t0=G10+G0=G01$$

In this manner, the liquid droplets that are discharged at the discharge position X3 with a flight speed V0 fly the distance G01 in the direction of the Z-axis for a flight time t3 (seconds) and fly for a distance D3 in the relative movement direction (the direction of the X-axis). That is, the liquid droplets that are discharged at the discharge position X3 with a flight speed V0 fly in a flight path S3 for a flight time t3 (seconds) and land onto the landing position X0 on the target printing surface F1.

By adjusting the position from which the liquid droplets are discharged by adjusting the discharge period of the liquid droplets, it is possible to control the landing positions and control the shifting of the landing positions that is caused by changes in the head gap.

As shown in FIG. 10D, it is possible to land onto the target printing surface F1 at the landing position X0 by setting the relative movement speed of the liquid droplet discharge head 20 and the target printing surface F1 as a relative movement speed U1. The relative movement speed U1 is determined in the following manner.

$$U1=U0\times(G0/G01)$$

A time taken to fly in the relative movement direction (the direction of the X-axis) for a distance D0 at a relative movement speed U1 is referred to as a flight time t4.

$$U1\times t4=D0$$

A flight distance in the direction of the Z-axis of the flight time t4 is V0×t4.

As described above, these parameters have the following relationship.

$$D0=t0\times U0$$

$$G0=t0\times V0$$

V0×t4 is determined from this relationship.

$$V0\times t4=V0\times(D0/U1)=V0\times(D0/(U0\times(G0/G01)))=V0\times(t0\times U0)\times G01/(U0\times t0\times V0)=G01$$

In this manner, the liquid droplets that are discharged at the discharge position X1 with a flight speed V0 in the direction of the Z-axis and fly at a relative movement speed U1 in the relative movement direction fly in the direction of the Z-axis for a distance of G01 for a flight time t4 (seconds) and fly for a distance D0 in the relative movement direction (the direction of the X-axis). That is, the liquid droplets that are discharged at the discharge position X1 with a flight speed V0 in the direction of the Z-axis and a flight speed (relative movement speed) U1 in the direction of the X-axis fly in a flight path S4 for a flight time t4 (seconds) and land onto the landing position X0 on the target printing surface F1.

By adjusting the position from which the liquid droplets are discharged by adjusting the relative movement speed of the liquid droplet discharge head 20 and the target printing surface F1, it is possible to control the landing positions and suppress the shifting of the landing positions that is caused by changes in the head gap.

As shown in FIG. 10E, it is possible to land onto the target printing surface F1 at the landing position X0 by adjusting the distance between the nozzle substrate 25 of the liquid droplet discharge head 20 and the target printing surface F1 in the direction of the Z-axis. The movement amount shown in FIG. 10E is an amount that corresponds to the gap G10. By shortening a distance between the target printing surface F1 and the nozzle substrate 25 by an amount that corresponds to the gap G10, a position (the distance from the nozzle substrate 25) in the direction of the Z-axis of the landing position X0 on the target printing surface F1 becomes the same as that on the target printing surface F0. As a result of this, in the same manner as the case of landing onto the target printing surface F0, the liquid droplets that are discharged at the discharge position X1 with a flight speed V0 in the direction of the Z-axis and fly at a relative movement speed U0 in the relative movement direction land onto the landing position X0 on the target printing surface F1.

By adjusting the head gap between the liquid droplet discharge head 20 and the target printing surface F1 corresponding to a change in head gap, it is possible to control the landing positions and suppress the shifting of the landing positions that is caused by changes in the head gap.

Printing Step

Figure 11:
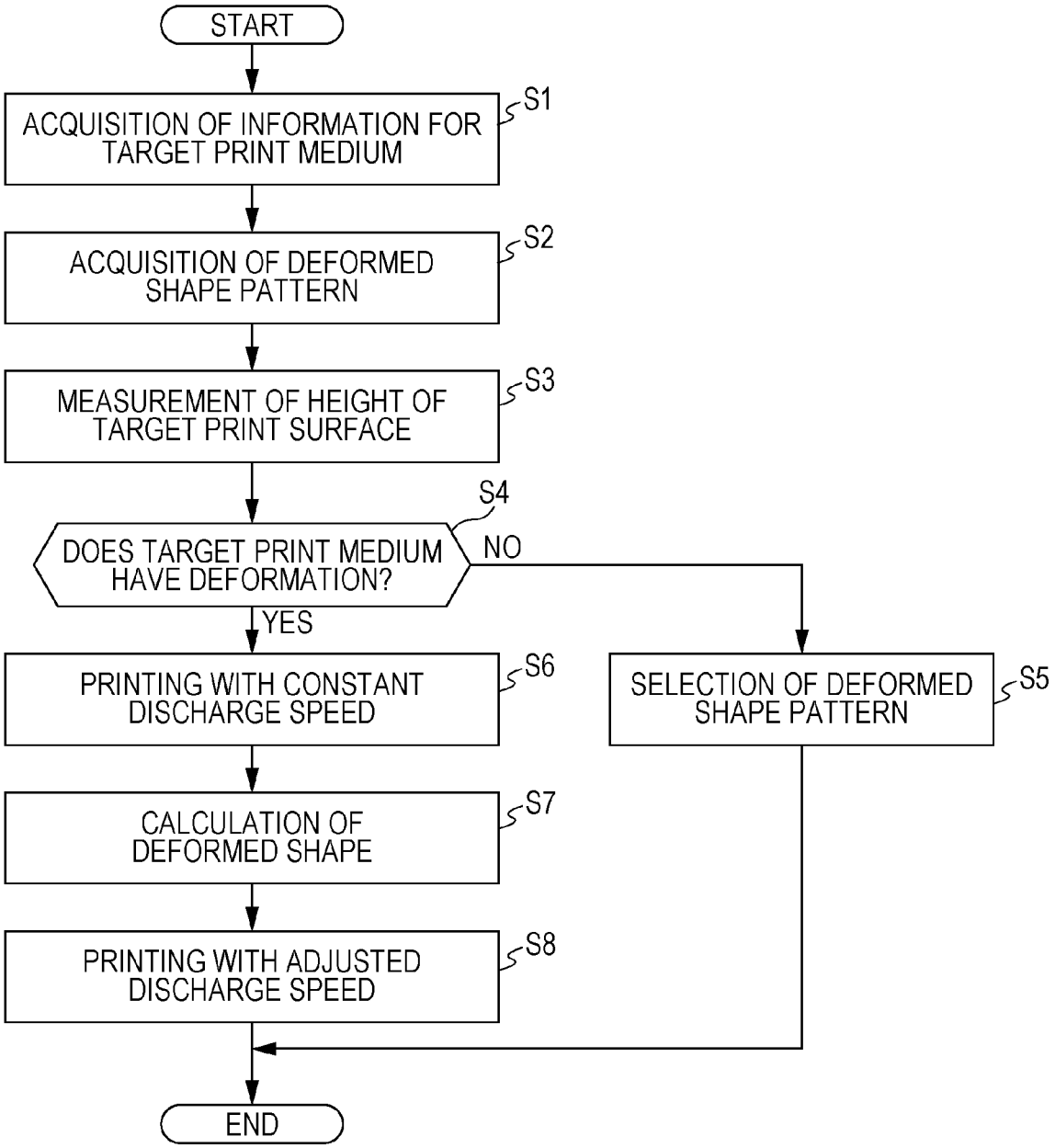
FIG. 11 is a flowchart that shows each process in the printing process.
Figure 12:
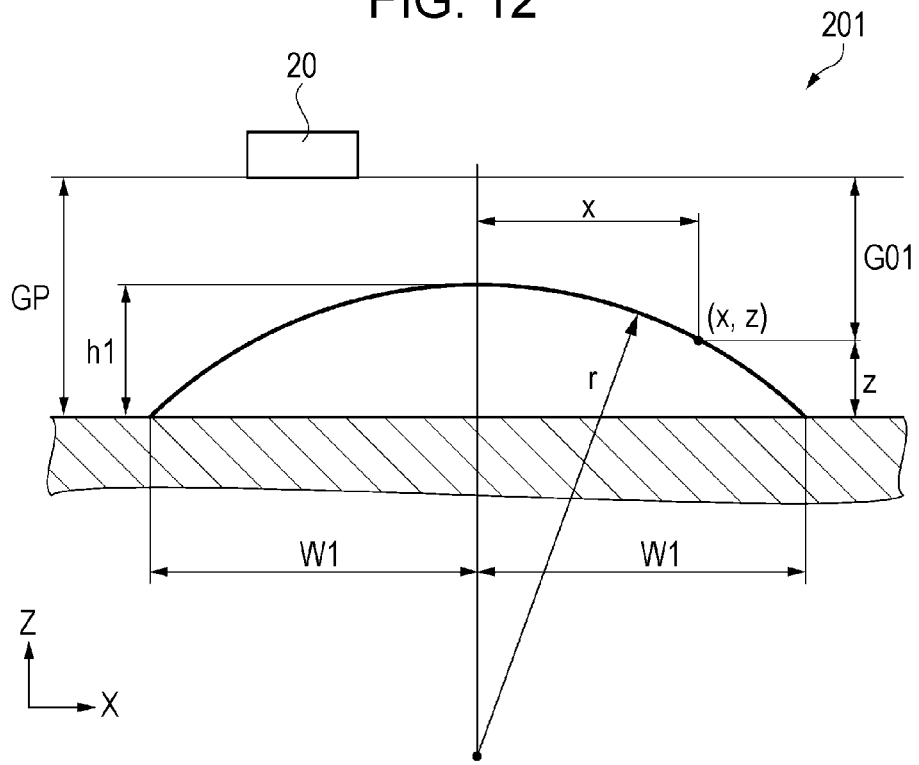
FIG. 12 is an explanatory drawing that shows a deformed shape pattern of the target print medium.
Figure 13:
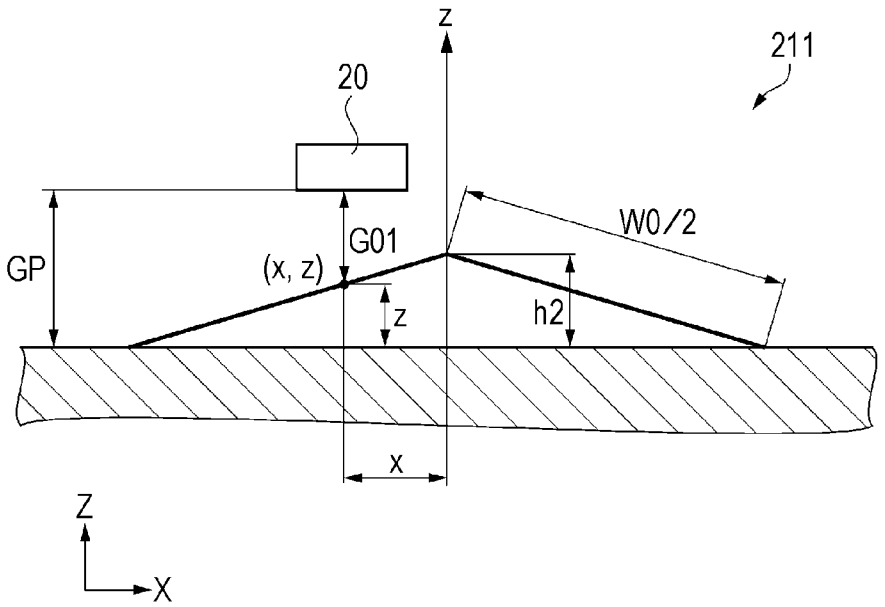
FIG. 13 is an explanatory drawing that shows a deformed shape pattern of the target print medium.
Figure 14:
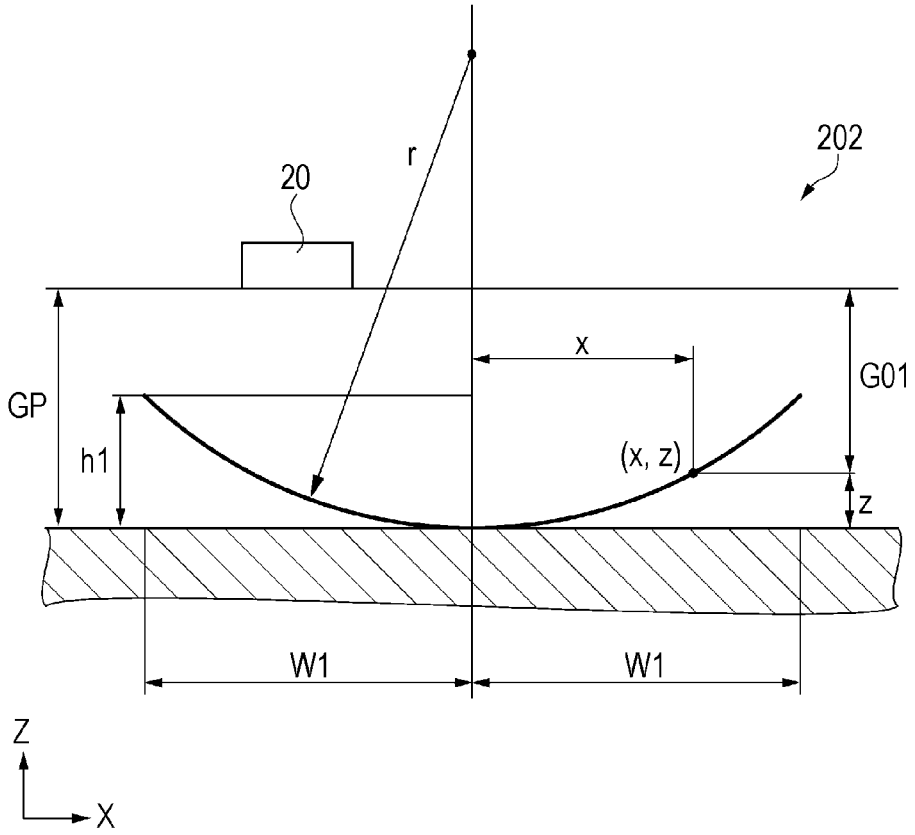
FIG. 14 is an explanatory drawing that shows a deformed shape pattern of the target print medium.

Next, a printing step that prints on a target print medium such as the chip printing body 15 using the liquid droplet discharge device 1 will be described with reference to FIGS. 11 to 14. The printing step that will be described here is a printing step that corresponds to a deformed target print medium. FIG. 11 is a flowchart that shows each process in the printing process. FIGS. 12 to 14 are explanatory drawings that show deformed shape patterns of the target print medium. The direction of the X-axis and the direction of the Z-axis shown in FIGS. 12 to 14 are consistent with the direction of the X-axis and the direction of the Z-axis shown in FIGS. 3A and 3B.

Firstly, in a Step S1 of FIG. 11, information that is related to the target print medium is acquired. The information that is related to the target print medium is respective dimensions such as the thickness, planar shape and the like of the target print medium.

Next, in a Step S2, a deformed shape pattern, which is a deformed shape of the target print medium that has been transformed into a pattern, is acquired and stored in the ROM 45 and the like. The deformed shape pattern shows typical characteristics of the deformed shape of the target print medium. The Step S2 corresponds to the pattern shape storage step. The ROM 45 and the like correspond to the pattern shape storage section.

A deformed shape pattern 201 shown in FIG. 12 is a deformed shape pattern in which the target print medium is curved in an arc-like manner. This is a pattern which is curved in an arc-like manner and in which both ends abut against the medium placement platform 30 and the center is high.

A deformed shape pattern 211 shown in FIG. 13 is a deformed shape pattern in which the target print medium is bent in the vicinity of the center thereof. This is a pattern in which both ends abut against the medium placement platform 30 and the center forms a high triangular chevron. For example, in the package printing body 10 that is explained with reference to FIG. 1A, since a slot is formed in the holding substrate 12 and portions of the slot which are weak are mainly easy to deform, it is possible to deform in the manner of the deformed shape pattern 211.

A deformed shape pattern 202 shown in FIG. 14 is a deformed shape pattern in which the target print medium is curved in an arc-like manner. This is a pattern which is curved in an arc-like manner and in which the center abuts against the medium placement platform 30 and both ends are high.

Next, in a Step S3 of FIG. 11, the height of a printing surface of a target print medium that is placed on the medium placement platform 30 is measured using the height detection unit 32. A position at which the height of the target print medium is measured is matched with a position of the height detection sensor 33 by moving the medium placement platform 30 in the direction of the X-axis using the X-axis scanning mechanism 31. In such a state, the height detection sensor 33 is elevated by the sensor elevating mechanisms 34, and the height of the target printing surface at the corresponding position is determined by detecting a height at which a luminous flux 330, which reaches from the light emitting section 33*a* to the light receiving section 33*b*, is blocked.

Step S3 corresponds to a detection step. The height detection unit 32 corresponds to the detection section. The sensor elevating mechanisms 34 correspond to the distance changing section. In a case of being used to match the position at which the height of the target print medium is measured with the position of the height detection sensor 33, the X-axis scanning mechanism 31 corresponds to the position changing section.

From the deformed shape patterns that are stored in the ROM 45 or the like in Step S2, as the position (portion) at which the height is measured, a position (portion) that can specify a deformed shape pattern that corresponds to a measured deformed shape of the target print medium is chosen. In addition, it is possible to choose a position (portion) that can specify a shape from a deformed shape pattern by setting the height to be a well-known height. For example, in a case in which a stored deformed shape pattern is the deformed shape pattern 201 or the deformed shape pattern 211, the height of the center of the target printing surface is measured. For example, in a case in which a stored deformed shape pattern is the deformed shape pattern 201 and the deformed shape pattern 211, the height at the center of the target printing surface and the height at a position between the center and an end are measured. For example, in a case in which a stored deformed shape pattern is the deformed shape pattern 201 and the deformed shape pattern 202, the height at the center of the target printing surface and the heights of both ends are measured.

Next, in a Step S4, it is determined whether or not the target print medium is deformed from the height of the target printing surface measured in Step S3. For example, in a case in which the deformed shape pattern that is stored in the ROM 45 or the like in Step S2 is the deformed shape pattern 201 or the deformed shape pattern 211, if the height of the center of the target printing surface is equivalent to the thickness of the target print medium, it is possible to the determine that the target print medium is not deformed. For example, in a case in which the deformed shape pattern that is stored in Step S2 is the deformed shape pattern 201 or the deformed shape pattern 202, if the height of the center of the target printing surface and the height at both ends are equivalent to the thickness of the target print medium, it is possible to the determine that the target print medium is not deformed.

In a case in which the target print medium is not deformed (NO in Step S4), the process proceeds to a Step S5. In a case in which the target print medium is deformed (YES in Step S4), the process proceeds to a Step S6.

After Step S4, in Step S5, printing is executed with the discharge speed from the liquid droplet discharge head 20 at a constant speed. That is, printing is performed without adjusting the flight speed of the liquid droplets that are discharged from the liquid droplets discharge head 20.

After Step S4, in Step S6, depending on the height of the target printing surface that is measured in Step S3, a deformed shape pattern that corresponds to the deformed shape of a target print medium that is placed on the medium placement platform 30 is selected from deformed shape patterns stored in the ROM 45 or the like in Step S2.

For example, in a case in which a stored deformed shape pattern is the deformed shape pattern 201 and the deformed shape pattern 211, it is determined whether or not the target printing surface is in straight line form or arc-like form from the height of the center of the target printing surface and the height of a position between the center and an end, and a deformed shape pattern that corresponds to the deformed shape pattern 201 or the deformed shape pattern 211 is selected. For example, in a case in which a stored deformed shape pattern is the deformed shape pattern 201 and the deformed shape pattern 202, it is possible to determine that the center or both ends are high from the height of the center of the target printing surface and the heights of both ends, and a deformed shape pattern that corresponds to the deformed shape pattern 201 or the deformed shape pattern 202 is selected.

Next, in Step S7, a deformed shape is calculated from the height of the target printing surface measured in Step S3 and the selected deformed shape pattern. It is possible to determine the head gap G01 by calculating a deformed shape using a position in the direction of the X-axis. The calculation of the deformed shape is executed by the CPU 44 according to a program that is input in advance. In this case, the CPU 44 corresponds to the head distance calculation section. Step S7 corresponds to the head distance calculation step.

As shown in FIG. 12, positional coordinates in the direction of the X-axis from the center of the deformed shape pattern 201 are expressed with an x, and heights of the deformed shape pattern 201 from the medium placement platform 30 that correspond to the coordinates x are expressed with a Z (print medium height z). The height at the highest point of the deformed shape pattern 201 is referred to as a maximum height point h1, and half of the width of the deformed shape pattern 201 is referred to as a width W1. It is possible to measure the maximum height point h1 and the width W1 in the measurement step of Step S3. A curvature radius of the deformed shape pattern 201 is referred to as a radius r.

In the deformed shape pattern 201, the maximum height point h1 and the width W1 have the following relationship with the radius r.

$$h1=r-\sqrt{r^2-(W1)^2} \quad \text{[Equation 1]}$$

The radius r can determined in the following manner from this equation. Since it is possible to measure the maximum height point h1 and the width W1, it is possible to calculate a value of the radius r from the measured values of the maximum height point h1 and the width W1.

$$r=\frac{1}{2\times h1}(h1^2+W1^2) \quad \text{[Equation 2]}$$

A medium height z that corresponds to the coordinates x is determined using the following equation.

$$z=h1-(r-\sqrt{r^2-x^2}) \quad \text{[Equation 3]}$$

A distance between the nozzle substrate 25 of the liquid droplet discharge head 20 and the medium placement platform 30 is referred to as a platen gap GP. The head gap G01 is determined in the following manner from the equation.

$$G01=GP-z$$

As shown in FIG. 13, in the same manner as the deformed shape pattern 201, positional coordinates in the direction of the X-axis from the center of the deformed shape pattern 211 are expressed with an x, and heights of the deformed shape pattern 211 from the medium placement platform 30 that correspond to the coordinates x are expressed with a Z (print medium height z). The height at the highest point of the deformed shape pattern 211 is referred to as a maximum height point h2, and half of the width of the target printing surface is referred to as a width W0. The width W0 is a value that includes the information that is related to the target print medium that is acquired in Step S1. It is possible to measure the maximum height point h2 in the measurement step of Step S3. The center of the deformed shape pattern 211 in the direction of the X-axis is the source point of the coordinates x and the x=0 at the center of the deformed shape pattern 211 in the direction of the X-axis.

A print medium height z that corresponds to the coordinates x is determined using the following equation.

In a case in which x<0

$$z=\frac{h2}{\sqrt{\left(\frac{W0}{2}\right)^2-h2^2}}x+h2 \quad \text{[Equation 4]}$$

In a case in which x≥0

$$z = -\frac{h2}{\sqrt{\left(\frac{W0}{2}\right)^2 - h2^2}}x + h2 \quad \text{[Equation 5]}$$

In the same manner as that of the deformed shape pattern 201, the head gap G01 is determined using the following equation.

$$G01 = GP - z$$

As shown in FIG. 14, in the same manner as the deformed shape pattern 201, the height of an end of the deformed shape pattern 202 is a maximum height point h1. It is also possible to calculate a value of the radius r from the measured values of the maximum height point h1 and the width W1 in the deformed shape pattern 202, in the same manner as the deformed shape pattern 201.

The print medium height z that corresponds to the coordinates x is determined using the following equation.

$$z = r - \sqrt{r^2 - x^2} \quad \text{[Equation 6]}$$

In the same manner as the deformed shape pattern 201 and the deformed shape pattern 211, the head gap G G01 is determined using the following equation.

$$G01 = GP - z$$

Next, a Step S8 in FIG. 11 printing is executed along with adjustment of the discharge speed of the liquid droplets, that is, the flight speed of the liquid droplets. As described with reference to FIGS. 9A and 9B, by configuring the speed of the liquid droplets in the direction of the Z-axis as the flight speed V1, it is even possible to land onto the target printing surface F1 at an landing position X0 in a case in which the target printing surface F0 is arranged to the target printing surface F1 and the head gap G0 changes. Step S8 corresponds to the liquid material arrangement step.

The adjustment of the flight speed of the liquid droplets is executed by the CPU 44 according to a program that is input in advance. In this case, the CPU 44 corresponds to the control section and also corresponds to the discharge speed adjustment section.

By executing Step S8 or Step S5, a printing process on a target print medium such as the chip printing body 15 using the liquid droplet discharge device 1 is completed.

As described with reference to FIGS. 9A and 9B, and 10C to 10E, it is possible to control the landing positions through the adjustment of the discharge period from the liquid droplet discharge head 20 (refer to FIG. 10C), the adjustment of the relative movement speed of the liquid droplet discharge head 20 and the target printing surface F1 (refer to FIG. 10D) and the adjustment of the head gap that corresponds to a change in head gap (refer to FIG. 10E). In Step S8 in FIG. 11, printing may be executed by controlling the landing positions through adjustment of the discharge period, adjustment of the relative movement speed or adjustment of the head gap that corresponds to a change in head gap.

The adjustment of the discharge period and the adjustment of the relative movement speed are executed by the CPU 44 according to a program input in advance. The CPU 44 corresponds to the discharge period adjustment section in a case in which adjustment of the discharge period is executed. The CPU 44 corresponds to the relative movement speed adjustment section in a case in which adjustment of the relative movement speed is executed.

In order to adjust the head gap, the liquid droplet discharge head 20 is caused to be detachably attached with respect to the target print medium using a head elevating mechanism that moves the head unit 21 in the direction of the Z-axis. Alternatively, a target print medium that is placed on the medium placement platform 30 is caused to be detachably attached with respect to the liquid droplets discharge head 20 using a placement platform elevating mechanism that moves the medium placement platform 30 in the direction of the Z-axis. The head elevating mechanism corresponds to the head attachment/detachment section. The placement platform elevating mechanism corresponds to the head attachment/detachment section. The CPU 44 that controls the head elevating mechanism or the placement platform elevating mechanism according to the head elevating mechanism or the placement platform elevating mechanism and a program input in advance corresponds to the control section.

Other Examples of Liquid Droplet Discharge Devices

Figure 15A:
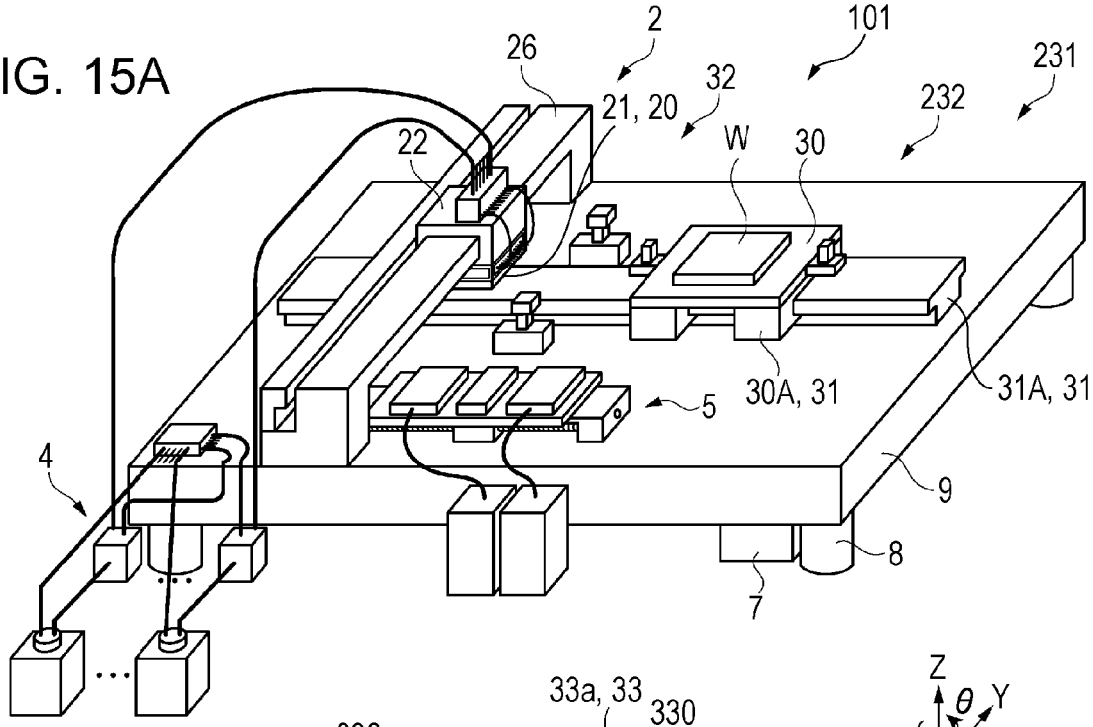
FIG. 15A is an external perspective drawing that shows a schematic configuration of a liquid droplet discharge device.
Figure 15B:
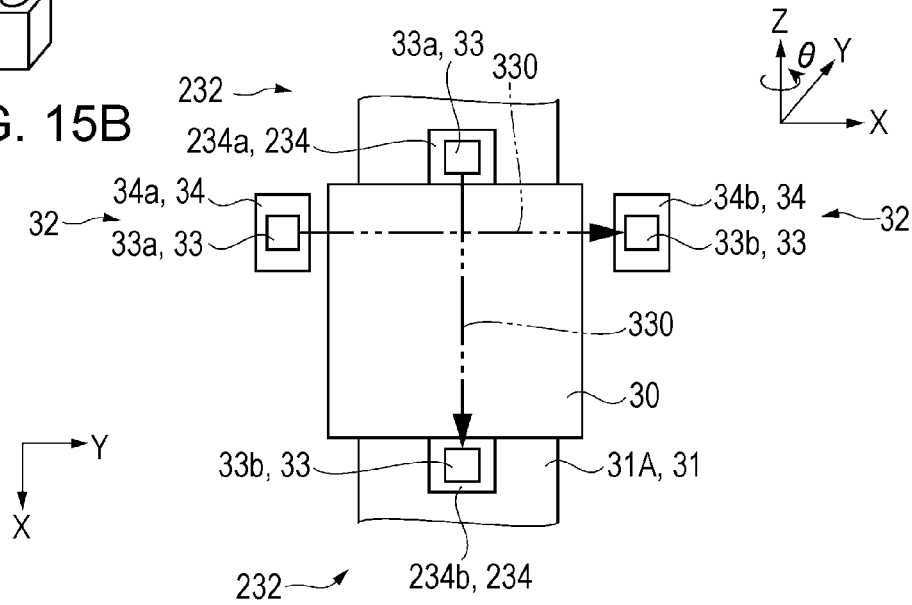
FIG. 15B is an explanatory drawing in plan view that shows a configuration of a height detection unit.
Figure 15C:
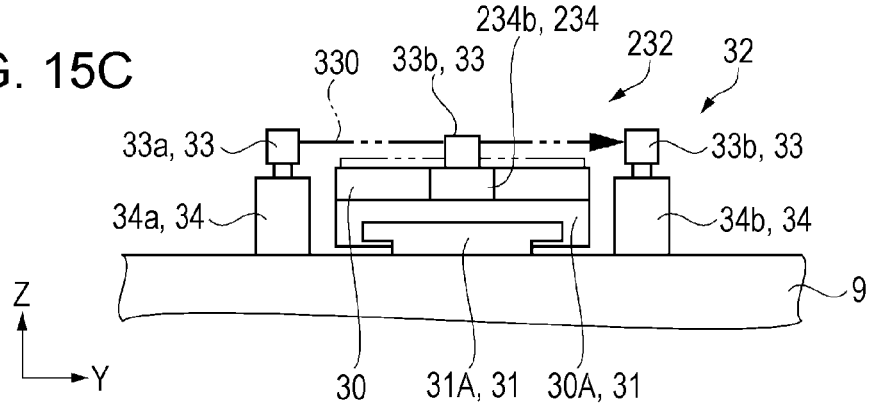
FIG. 15C is an explanatory drawing in lateral view that shows a configuration of the height detection unit.

Next, an overall configuration of a liquid droplet discharge device 101, a portion of the configuration of which differs from that of the liquid droplet discharge device 1, will be described with reference to FIGS. 15A to 15C. FIGS. 15A to 15C are drawings that show a schematic configuration of a liquid droplet discharge device. FIG. 15A is an external perspective drawing that shows a schematic configuration of the liquid droplet discharge device. FIG. 15B is an explanatory drawing in plan view that shows a configuration of a height detection unit. FIG. 15C is an explanatory drawing in lateral view that shows a configuration of the height detection unit.

As shown in FIG. 15A, the liquid droplet discharge device 101 is provided with the head mechanism section 2, a medium mechanism section 231, the functional liquid supply section 4, the maintenance device section 5 and the discharge device control section 7. In the liquid droplet discharge device 101, apart from a portion of the configuration of the medium mechanism section 231 differing from the configuration of the medium mechanism section 3 of the liquid droplet discharge device 1, the configuration is the same as that of the liquid droplet discharge device 1. The liquid droplet discharge device 101 corresponds to the printing apparatus.

The medium mechanism section 231 is provided with a height detection unit 232 in addition to the configuration of the medium mechanism section 3. The height detection unit 232 is provided with the height detection sensor 33 and sensor holding mechanisms 234. The height detection sensor 33 is the same as the height detection sensor 33 that the height detection unit 32 is provided with, and is provided with the light emitting section 33*a* and the light receiving section 33*b*. The light emitting section 33*a* and the light receiving section 33*b* are respectively fixed to the front ends of the sensor holding mechanisms 234. The sensor holding mechanism 234 which supports the light emitting section 33*a* is referred to as a sensor holding mechanism 234*a* and the sensor holding mechanism 234 which supports the light receiving section 33*b* is referred to as a sensor holding mechanism 234*b*. The sensor holding mechanism 234*a* and the sensor holding mechanism 234*b* are arranged on both sides of the medium placement platform 30 in the direction of the X-axis, and are fixed to a side surface of the medium placement platform 30. The light emitting section 33*a* and the light receiving section 33*b* are fixed to the medium placement platform 30 through the sensor holding mechanisms 234. The light emitting section 33*a* and the light receiving section 33*b* can be moved in the direction of the Z-axis by the sensor holding mechanism 234, and are capable of being held at an arbitrary height. At a time of executing printing, the light emitting section 33*a* and the light receiving section 33*b* are held at a height at which the light emitting section 33*a* and the light receiving section 33*b* do not protrude further than height of an upper surface that places the medium placement platform 30.

The light emitting section 33*a* is held on the sensor holding mechanism 234*a* in a posture in which a light axis of an emitted luminous flux 330 becomes the direction of the X-axis. The light receiving section 33*b* is held on the sensor holding mechanism 234*b* with a light detection surface thereof facing toward the light emitting section 33*a* side. The height relationship between the light emitting section 33*a* and the light receiving section 33*b* in the direction of the Z-axis is referred to as the light emitting section 33*a* and the light receiving section 33*b* being the same height in a state in which the light axis of the luminous flux 330 is consistent with the center of the light detection surface of the light receiving section 33*b*.

The height detection unit 232 is the same as the height detection unit 32, and can detect the height of a target printing surface of a chip printing body 15 or the like that is placed on the medium placement platform 30.

Figure 16:
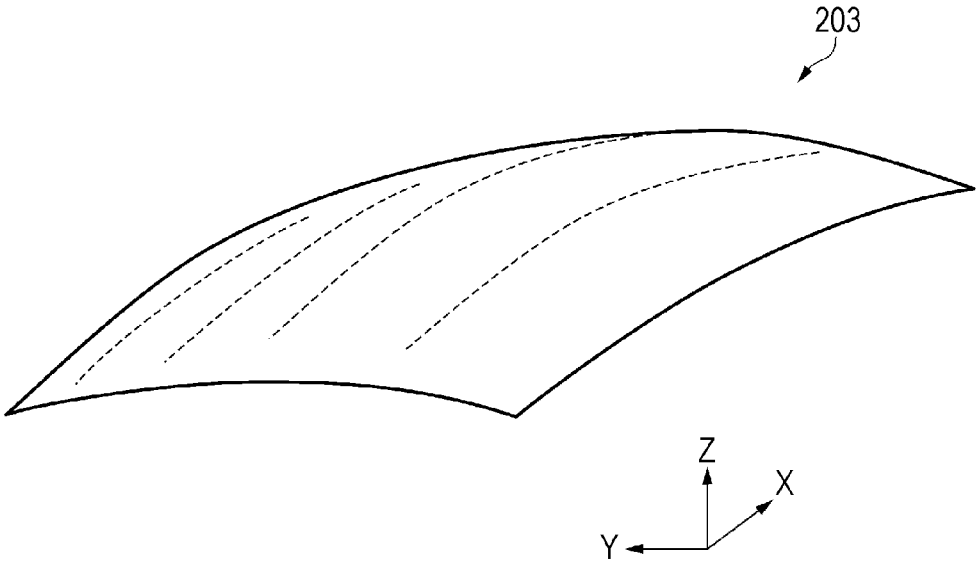
FIG. 16 is an explanatory drawing that shows a deformed shape pattern of the target print medium.

By using the height detection unit 232 and the height detection unit 32, it is possible to detect the shape of a target print medium in more detail in comparison with a case of using the height detection unit 32 only. FIG. 16 is an explanatory drawing that shows a deformed shape pattern of a target print medium. The deformed shape pattern 203 shown in FIG. 16 has a shape in which a cross-sectional shape of a cross-section in the direction of the X-axis and a cross-sectional shape of a cross-section in the direction of the Y-axis are bent. By using the height detection unit 232 in addition to the height detection unit 32, it is possible to discriminate whether a shape is uniform in the direction of the Y-axis like that of the deformed shape pattern 201 or whether a shape is altered in the direction of the X-axis and the direction of the Y-axis like that of the deformed shape pattern 203.

Control of Distance Between Landing Positions

Next, the control of the distance between landing positions on a target print medium will be described. As described with reference to FIGS. 9A and 9B, and 10C to 10E, it is possible to correct shifting of the landing positions that is caused by deformation of a target print medium in the scanning direction (the direction of the X-axis) of the liquid droplet discharge device 1. However, a distance along the target printing surface F1 that corresponds to the direction of the X-axis becomes longer than the distance of the direction of the X-axis. Therefore, the interval on a target print medium between the landing positions of liquid droplets that are landed onto accurate positions at the time of executing printing becomes slightly wider than the accurate interval between the landing positions. In other words, as a result of printing, the interval between landing positions becomes slightly wider than the accurate interval between landing positions.

In Step S7 of FIG. 11, a deformed shape is calculated from the height which is measured in step S3 of a target printing surface and the deformed shape pattern. It is possible to determine a relationship between the distance of the direction of the X-axis and the distance along the target printing surface from the deformed shape. It is possible to control the landing positions on the target print medium more accurately by deciding on the position in the direction of the X-axis that will be landed onto having taken the distance of the direction of the X-axis and the distance along the target printing surface into account.

For example, at the time of forming an arrangement table that indicates arrangement positions at which liquid droplets are arranged and discharge nozzles 24 that discharge liquid droplets on the corresponding positions, a position for which the distance of the target printing surface has been converted into the distance in the direction of the X-axis is used.

Alternatively, as described with reference to FIG. 8C, the minimum landing distance d in the direction of the X-axis is the product of the relative movement speed in the direction of the X-axis (the main scanning direction) and the minimum discharge interval of the discharge nozzles 24. For example, the relative movement speed at the time of executing printing is set as a relative movement speed that corresponds to a distance in the direction of the X-axis that corresponds to the distance along the target printing surface. As a result of this, it is possible to set the minimum landing distance d as a minimum landing distance that corrects a difference between the distance in the direction of the X-axis and the distance along the target printing surface.

For example, the minimum discharge interval (discharge period) at the time of executing printing is set as a minimum discharge interval that corresponds to a distance in the direction of the X-axis that corresponds to the distance along the target printing surface. As a result of this, it is possible to set the minimum landing distance d as a minimum landing distance that corrects a difference between the distance in the direction of the X-axis and the distance along the target printing surface.

Hereinafter, the effects that result from the embodiment will be listed. According to the embodiment, it is possible to obtain the following effects.

(1) The liquid droplet discharge device 1 is provided with the height detection unit 32. Using the height detection unit 32, it is possible to measure the height of a target print medium that is placed on the medium placement platform 30.

(2) The printing step has a step that determines whether or not a target print medium is deformed from the height of a measured target printing surface. In a case in which the target print medium is not deformed, it is possible to execute the printing step without executing a step of adjusting the landing positions. As a result of this, it is possible to suppress a situation in which unnecessary processes are executed.

(3) In the printing step, a deformed shape is calculated from the measured height of a target printing surface and a deformed shape pattern. As a result of this, it is possible to determine the deformed shape of the target printing surface in detail by measuring the height at a small number of measuring points without having to measure the shape in detail.

(4) In the printing step, a deformed shape is calculated from the measured height of a target printing surface and a deformed shape pattern. In addition to shifting in the direction of the Z-axis, it is possible to set a distance on a printing surface in a direction that is along the target printing surface with respect to the distance in the direction of the X-axis as a well-known distance by setting the deformed shape to be a well-known deformed shape. It is possible to suppress a situation in which a distance between land points on a printing surface changes as a result of deformation of a target print medium by setting positions onto which the liquid droplets are caused to land as positions that take a relationship between the distance in the direction of the X-axis and the distance on the printing surface in a direction that is along the target printing surface into account.

(5) The liquid droplet discharge device 101 is provided with a height detection unit 32 and a height detection unit 232. Respective regions in the height detection unit 32 and the height detection unit 232 in which height can be measured are arranged in positions that intersect one another in the direction which is parallel to the placement surface of the medium placement platform 30. Using the height detection unit 32 and the height detection unit 232, it is possible to measure the height of a target print medium from two directions. As a result of this, by measuring the height, it is possible to measure the shape of a target print medium in detail in comparison with a case in which one device measures the height.

In the description above, preferred embodiments have been described while referring to the appended drawings, but the preferred embodiments are not limited to the abovementioned embodiments. Naturally, various changes can be made to the embodiments within a range that does not depart from the scope of the embodiments, and it is also possible to implement the embodiments in the following forms.

Modification Example 1

In the abovementioned embodiments, as detection section, a configuration in which the height detection sensor 33, which the height detection unit 32 is provided with, is provided with the light emitting section 33*a* and the light receiving section 33*b* is adopted. However, it is not essential that the detection section have a configuration in which a light emitting section and a light receiving section are provided. For example, the detection section may be a distance detection device, may be disposed facing a holding surface of the medium holding section and may be a device which detects a shape of a target print medium by measuring a distance of the target print medium on a holding surface. Alternatively, the detection section may acquire images from a side surface of a target print medium and may be a device which detects a height of the target print medium from the images.

Modification Example 2

In the abovementioned embodiments, the height detection sensor 33 which the height detection unit 232 is provided with is held so as to be capable of being moved in the direction of the Z-axis by the sensor holding mechanism 234. However, the device that holds the height detection sensor 33 may have a configuration that is provided with a movement device that can move the height detection sensor 33 in the direction of the Y-axis with respect to the medium placement platform 30. That is, the device that holds the detection section may have a configuration of being provided with a movement device which can move the detection section in a direction that is parallel to a holding surface of the medium holding section with respect to the medium holding section. A movement device in this case corresponds to the position changing section.

Modification Example 3

In the abovementioned embodiments, as a printing apparatus, the liquid droplet discharge device 1 is provided with a single height detection unit 32 as a detection section. However, the printing apparatus may have a configuration of being provided with a plurality of detection section. By activating a plurality of detection section concurrently, it is possible to quickly detect a shape. In addition, it is possible to detect a shape at a plurality of positions on a target print medium without the need for a position changing section.

Modification Example 4

In the abovementioned embodiments, the height detection unit 32 is provided with a single height detection sensor 33. However, the set of the light emitting section and the light receiving section that the detection section is provided with need not necessarily be a single set. The detection section may be provided with a plurality of sets of light emitting sections and light receiving sections, and may have a configuration in which the plurality of sets of light emitting sections and light receiving sections are moved simultaneously by a single distance changing section.

Modification Example 5

In the abovementioned embodiments, the liquid droplet discharge device 1 is a device that prints an image such as the chip printing image 150A on a printing object such as the chip printing body 15, and a target print medium is a chip printing body 15 or a package printing body 10. However, a target print medium, which is a target for the execution of printing of a printing apparatus such as the liquid droplet discharge device 1 that is described in the abovementioned embodiments, may be a different medium. For example, a substrate on which fabric is placed may be configured as a target print medium.

Modification Example 6

In the abovementioned embodiments, the liquid droplet discharge device 1 is provided with a Y-axis scanning mechanism 26 that moves the head unit 21, which has the liquid droplet discharge head 20, in the direction of the Y-axis. However, it is not essential that the liquid droplet discharge head be moved in a line feed direction (the direction of the Y-axis in the abovementioned embodiment). The liquid droplet discharge device may have a configuration which is provided with discharge nozzles rows that are capable of discharging toward the entire width of a target print medium.

Modification Example 7

In the abovementioned embodiments, the liquid droplet discharge device 1 disposes a functional liquid by discharging the functional liquid from the liquid droplet discharge head 20 in addition to moving the medium placement platform 30 that places a target print medium in the direction of the X-axis. In addition, the position of the liquid droplet discharge head 20 (the discharge nozzles 24) with respect to the target print medium or the like is matched by moving the head unit 21 in the direction of the Y-axis. However, with respect to the liquid droplet discharge head and a target print medium, the execution of relative movement in the discharge scanning direction (the direction of the X-axis in the abovementioned embodiment) by moving the target print medium, and the execution of relative movement in a line feed direction (the direction of the Y-axis in the abovementioned embodiment) by moving the discharge head are not essential.

Relative movement of the discharge head and a target print medium in the discharge scanning direction may be executed by moving the discharge head in the discharge scanning direction. Relative movement of the discharge head and a target print medium in the line feed direction may be executed by moving the target print medium in the line feed direction. Alternatively, relative movement of the discharge head and a target print medium in the discharge scanning direction and the line feed direction may be executed by moving either one of the discharge head and the target print medium in the discharge scanning direction and the line feed direction, and may be executed by moving both the discharge head and the target print medium in the discharge scanning direction and the line feed direction.

The entire disclosure of Japanese Patent Application No. 2012-141703, filed Jun. 25, 2012 is expressly incorporated by reference herein.

What is claimed is:

1. A printing apparatus comprising:

a medium holding section that holds a target print medium;

a discharge head, which is provided with a nozzle surface in which discharge nozzles that discharge liquid droplets are open, the nozzle surface being arranged so as to be able to face a holding surface of the medium holding section that holds the target print medium;

a relative movement section that moves the discharge head and the medium holding section relatively;

a pattern shape storage section that stores a shape pattern of the target print medium;

a detection section that detects at least one piece of positional information for a target print medium held in the medium holding section;

a head distance calculation section that calculates a shape of the target print medium by comparing at least one piece of positional information that is detected with the shape pattern, and calculates a distance between the nozzle surface and the target printing surface of the target print medium from the shape; and a control section that controls at least one of the discharge head and the relative movement section depending on the shape, wherein the detection section includes:

a light emitting section that emits light that travels in at least a direction that is parallel to the holding surface, a light receiving section that detects the light emitted from the light emitting section, and a distance changing section that changes a distance in a direction that is perpendicular to the holding surface between a light path, which reaches from the light emitting section to the light receiving section, and the holding surface.

2. The printing apparatus according to claim 1, wherein the head distance calculation section further calculates a relationship between a distance in a relative movement direction by the relative movement section and a distance along the target printing surface from the shape, and the control section causes liquid droplets to be landed onto landing positions for which a distance between landing positions on the target printing surface becomes a predetermined distance on the basis of the relationship between the distance in the relative movement direction and the distance along the target printing surface.

3. The printing apparatus according to claim 1, wherein the detection section is provided with a plurality of sets of light emitting sections and light receiving sections.

4. The printing apparatus according to claim 1, wherein the detection section further includes a position changing section that changes relative positions of the light receiving section and light emitting section and the holding surface in a direction that is parallel to the holding surface.

5. The printing apparatus according to claim 1, wherein the control section includes a discharge speed adjustment section, that adjusts a flight speed of the liquid droplets that are discharged from the discharge nozzles, and controls landing positions by adjusting the flight speed of the liquid droplets.

6. The printing apparatus according to claim 1, wherein the control section includes a discharge period adjustment section, that adjusts the discharge period from the discharge nozzles, and controls landing positions by adjusting the discharge period of the liquid droplets.

7. The printing apparatus according to claim 1, wherein the control section includes a relative movement speed adjustment section, that adjusts the relative movement speed by the relative movement section, and controls landing positions by adjusting the relative movement speed.

8. The printing apparatus according to claim 1, wherein the control section includes a head attachment/detachment section, that detachably attaches the discharge head and the medium holding section in a direction that is perpendicular to the nozzle surface, and controls landing positions by adjusting the distance between the nozzle surface and the target printing surface.

9. A printing method that forms images by arranging liquid material on a target print medium in such a manner that liquid droplets are discharged from discharge nozzles while relatively moving a discharge head, which is provided with a nozzle surface in which the discharge nozzles that discharge the liquid material as the liquid droplets are open, and the target print medium, the printing method comprising:

storing a shape pattern of the target print medium;

emitting light, by a light emitting section, that travels in at least a direction that is parallel to a holding surface of a medium holding section, wherein the medium holding section holds the target print medium;

detecting, by a light receiving section, the light emitted from the light emitting section;

changing a distance in a direction that is perpendicular to the holding surface between a light path and the holding surface;

detecting at least one piece of positional information for the target print medium;

calculating a shape of the target print medium by comparing at least one piece of positional information that is detected with the shape pattern, and calculating a distance between the nozzle surface and the target printing surface of the target print medium from the shape; and landing the liquid droplets onto the target printing surface by controlling landing positions of the liquid droplets depending on the shape.

10. The printing method according to claim 9, wherein in the calculating, a relationship between a distance in a relative movement direction and a distance along the target printing surface from the shape, and in the calculating, the liquid droplets on discharge positions for which a distance between discharge positions on the target printing surface becomes a predetermined distance on the basis of the relationship between the distance in the relative movement direction and the distance along the target printing surface.

* * * * *